US005439064A

United States Patent [19]

Patton

[11] Patent Number: 5,439,064

[45] **Date of Patent: * Aug. 8, 1995**

[54] SYSTEM FOR CONTROLLED DRILLING OF BOREHOLES ALONG PLANNED PROFILE

[75] Inventor: Bob J. Patton, Dallas, Tex.

[73] Assignee: Patton Consulting, Inc., Dallas, Tex.

[ * ] Notice: The portion of the term of this patent subsequent to Jun. 22, 2010 has been disclaimed.

[21] Appl. No.: 960,191

[22] Filed: Oct. 9, 1992

Related U.S. Application Data

[63] Continuation of Ser. No. 505,895, Apr. 6, 1990, abandoned, which is a continuation of Ser. No. 455,255, Dec. 22, 1989, Pat. No. 5,220,963.

[51] Int. Cl.[6] ..... E21B 7/04; E21B 44/00

[52] U.S. Cl. ..... 175/24; 175/45

[58] Field of Search ..... 175/40, 45, 61, 73, 175/24, 26, 27; 367/33; 73/151.5; 33/773, 772

[56] References Cited

U.S. PATENT DOCUMENTS

| | | | |
|---|---|---|---|
| 3,713,500 | 1/1973 | Russell | 175/73 |
| 3,789,355 | 1/1974 | Patton | 367/83 X |
| 3,800,277 | 3/1974 | Patton et al. | 175/24 X |
| 4,114,435 | 9/1978 | Patton et al. | 364/562 X |
| 4,117,600 | 10/1978 | Guignard et al. | 367/33 X |
| 4,156,467 | 5/1979 | Patton et al. | 73/151.5 X |
| 4,303,994 | 12/1981 | Tanguy | 175/45 X |
| 4,324,297 | 4/1982 | Denison | 175/45 |
| 4,445,578 | 5/1984 | Mollheim | 175/61 X |
| 4,479,564 | 10/1984 | Tanguy | 175/45 X |
| 4,592,432 | 6/1986 | Williams et al. | 175/26 |
| 4,596,293 | 6/1986 | Wallussek et al. | 175/45 X |
| 4,662,458 | 5/1987 | Ho | 175/45 X |
| 4,733,733 | 3/1988 | Bradley et al. | 175/45 |
| 4,739,841 | 4/1988 | Das | 175/61 |
| 4,747,303 | 5/1988 | Fontenot | 175/45 X |
| 4,760,735 | 8/1988 | Sheppard et al. | 73/151 |
| 4,805,449 | 2/1989 | Das | 73/151 |
| 4,821,563 | 4/1989 | Mason | 175/40 X |
| 4,828,050 | 5/1989 | Hashimoto | 175/61 X |
| 4,854,397 | 8/1989 | Warren et al. | 175/27 X |
| 4,858,705 | 8/1989 | Thiery | 175/73 |
| 4,905,774 | 3/1990 | Wittrisch | 175/26 |

FOREIGN PATENT DOCUMENTS 2177738 8/1988 United Kingdom .

OTHER PUBLICATIONS

Cook, R. L. et al, "First Real Time Measurements of Down Hle Vibrations, Forces, and Pressures Used to Monitor Directional Drilling Operations," SPE/IADC 18651 Mar. 1989.

Delafon, H. "BHA Prediction Software Improves Directional Drilling," World Oil, Mar. 1989, pp. 45–50.

Delafon, H., "BHA Prediction Software Improves Directional Drilling," World Oil, Apr. 1989, pp. 50–60.

*Primary Examiner*—Hoang C. Dang

*Attorney, Agent, or Firm*—Gambrell, Wilson & Hamilton

[57] ABSTRACT

An improved method and apparatus for controlling the direction of advance of a rotary drill to produce a borehole profile substantially as preplanned with minimal curvature while maintaining optimum drilling performance. The preferred embodiment of the system comprises a drill string; a rotatable drill bit carried on said drill string; and a compliant subassembly in said drill string, said compliant subassembly facilitating changes in the direction of drilling of said borehole. The system further comprises a plurality of sensors for measuring strains within the compliant subassembly and for producing data signals corresponding to the strain measurements. A control system is operable to use the data signals to change the direction of the borehole by applying a shear force to the drill bit.

16 Claims, 15 Drawing Sheets

SYSTEM FOR CONTROLLED DRILLING OF BOREHOLES ALONG PLANNED PROFILE

CONTINUING APPLICATION DATA

This is a continuation of application Ser. No. 07/505,895 filed on Apr. 06, 1990, now abandoned, which is a continuation of Ser. No. 07/455,255 filed Dec. 22, 1989, now the U.S. Pat. No. 5,220,963.

FIELD OF THE INVENTION

The present invention relates generally to a method and apparatus for drilling of boreholes along a previously planned three-dimensional profile. More specifically, the present invention provides a method and apparatus for automatically controlling the direction of advance of a rotary drill to produce a borehole profile substantially as preplanned with minimal curvature while maintaining optimum drilling performance.

BACKGROUND

As the easily exploited hydrocarbon energy sources have been depleted, oil and gas wells have been drilled to ever deeper depths and have required more complex technology. Much of the current drilling activity is conducted from offshore drilling platforms which often support twenty or more wells. All but one of the wells drilled from such a platform are necessarily deviated from the vertical axis. Several methods for changing and controlling the direction of deviated or non-vertical boreholes have been developed and employed with varying levels of success and quality. One of the earlier and more successful interim methods was called a whip stock. The whipstock is basically a shaped body, generally iron or steel, placed in the existing borehole and oriented to deflect the drill into the desired direction. After the borehole is given this initial kick-off, a specially designed Bottom Hole Assembly (BHA) is used in an attempt to change the direction to the desired value. Multiple design changes are often required to get acceptable results. The BHA is then changed to a design intended to drill straight ahead. This whipstock method, as crude, inaccurate and cumbersome as it is, served the drilling for many years but is used less today. Another relatively old and useful method for changing and controlling the direction of a borehole is directional hydraulic jetting. In this method, the bit jets are arranged to produce eroding jet streams in an off-vertical direction while the drill is not rotating and the jet streams are oriented in the desired drilling direction. After a period of directional jetting, the drill is rotated to drill ahead a short distance. A series of such small steps can be used to turn to the desired direction. In soft formations, the jetting action is sufficient to cause drilling in the desired direction. This method is subject to the formation properties and prone to much trial and error.

Modern directional drilling practice generally employs downhole mud motors, a bend in the BHA or offset stabilizer, and a directional survey instrument to determine the direction of the bend. Commonly, the direction of the bend or offset is called Tool Face Orientation (TFO) and is determined either by gravity methods, or magnetic measurement. Today, this TFO information is generally provided in real time by either direct wireline or a Measurements-While-Drilling (MWD) system which most often uses mud telemetry.

There are two versions of the bend in the BHA. One is called a bent sub which is located above the drill motor. The location of the bent sub is too far from the bit to allow significant rotation of the drill string without causing undue stresses and component fatigue. Consequently, the use of the bent sub restricts drilling operations to substantially constant TFO. Thus the rate of curvature of the hole by this method is not dynamically controllable but rather is set by the BHA design and the drilling conditions. It is often necessary to make multiple trips in and out of the hole to change the BHA design until a satisfactory curvature is obtained.

The second version of the bend in the BHA is the so-called bent housing motor wherein there is a slight bend in the bottom section of the motor. This small bend in the motor causes a curvature in the hole in the direction of the bend much as in the case of the bent sub. The rate of curvature of the hole with constant TFO is a function of the bend and other BHA design factors along with borehole properties. Like the bent sub method, the rate of curvature of the bent housing method is not precisely controllable by design. However, the bent housing motor, due to its short bent section, can be rotated continuously or intermittently in the hole. By selective time sharing of the rotation and constant TFO operational modes, any value of average curvature between zero and the maximum value at constant TFO operation can be obtained. This basic capability reduces the number of trips into and out of the hole thus saving time over the bent sub method. However the quality of the hole drilled by this method suffers from the interleaving of the multiple straight sections and excessive curvature sections caused by this method.

The offset stabilizer method often used with turbine type downhole motors is similar to the bent housing system in that it will turn when a constant TFO is held and will drill straight ahead when the drill pipe is rotated. The turn is caused by the offset stabilizer putting a side force on the bit. The results are virtually identical with the bent housing motor system.

Most deviated wells drilled today are drilled basically in a two dimensional vertical plane from the surface location, most often an offshore platform, to the target location. Most such wells contain three distinct sections; a straight down vertical section, a build angle section in the desired direction, and a hold angle (inclination) straight section. Some wells also contain and additional drop angle section or a drop angle to vertical section and a bottom vertical section. Also horizontal wells are becoming popular wherein there is a long horizontal section that has near zero degrees inclination. The horizontal sections are generally in the producing zone for the purpose of enhanced production. When the producing zone is thin, very accurate directional drilling is required and almost always horizontal drilling increases the need for smooth, quality hole without excessive dogleg.

One of the most dominant features of a deviated well is the long hold section which follows the build section. The need here is to drill a quality hole straight ahead with minimal dogleg as quickly as possible. Standard rotary drilling wherein the bit is rotated by rotation of the entire drill string is the preferred method of drilling this section of the hole due to its higher penetration rate, higher quality of hole and long life of the components. The chief disadvantage of this method is that there is is no directional drilling method to control the azimuth of the borehole. So called packed hole assemblies (A BHA designed to drill straight ahead) are used in attempts to minimize the walk or wandering in azimuthal direction of the borehole with minimal success. Generally, multiple corrections of the borehole direction are required during this straight section. This is done by pulling the packed hole rotary drilling assembly from the hole and replacing it with a downhole motor and bent BHA to accomplish the directional correction. Then another trip is made to replace the rotary drilling assembly. This process must be repeated each time the direction of the borehole drifts too far from the plan. The bent housing downhole motor may be alternately used in this straight section at the sacrifice of longer times, higher costs and possibly higher dogleg hole. This higher dogleg effect is documented in the paper "First Real Time Measurements of Downhole Vibrations, Forces, and Pressures Used to Monitor Directional Drilling Operations", Cook, R. L. and Nicholson, J. W., SPE/IADC 18651, SPE/IADC Drilling Conference, New Orleans, LA, Feb. 28–Mar. 3, 1989.

The latest technology in this area is represented by two technical publications by Henry Delafon: "BHA Prediction Software Improves Directional Drilling, Parts 1 and 2" *World Oil* March and April 1989. Delafon demonstrates that in some environments sophisticated computer design of the BHA configuration can be used to reduce the number of direction corrections needed during the hold section using rotary drilling.

In view of this foregoing discussion, it is evident that a better and more efficient method of controlled directional drilling is needed.. More specifically, it is apparent that there is a need to incorporate a method of directional control into standard rotary drilling which produces little or no interference with the optimal drilling efficiency of the rotary method. The directional rotary method described in greater detail below, provides a method and apparatus for continuously and automatically controlling the direction of an optimal rotary drill such that the borehole is drilled substantially along a preplanned profile with minimal dogleg in minimum time without tripping for directional purposes.

SUMMARY OF THE INVENTION

The present invention overcomes the difficulties of the prior art by providing an improved method and apparatus for automatically controlling the direction of advance of a rotary drill to produce a borehole profile substantially as preplanned with minimal curvature while maintaining optimum drilling performance. The preferred embodiment of the system comprises a drill string; a drill bit; means for rotating said drill bit; means for storing a planned path; means for obtaining information for providing a profile of a drilled path of said borehole; means for comparing said drilled path with said planned path and for generating a correction signal representing the difference between said drilled path and said planned path; and means responsive to said correction signal to cause said drilling means to calculate a corrected path to cause the drilled borehole to coincide with said planned path. The means for providing information relating to said drilled path comprises means for obtaining information relating to the instantaneous depth of said drill bit within said borehole and means for obtaining information relating to the instantaneous direction of said drill bit within said formation and further comprising means for utilizing said depth information and said direction information to provide said profile of the drilled path.

DETAILED DESCRIPTION OF THE PREFERRED EMBODIMENT

Figure 1:
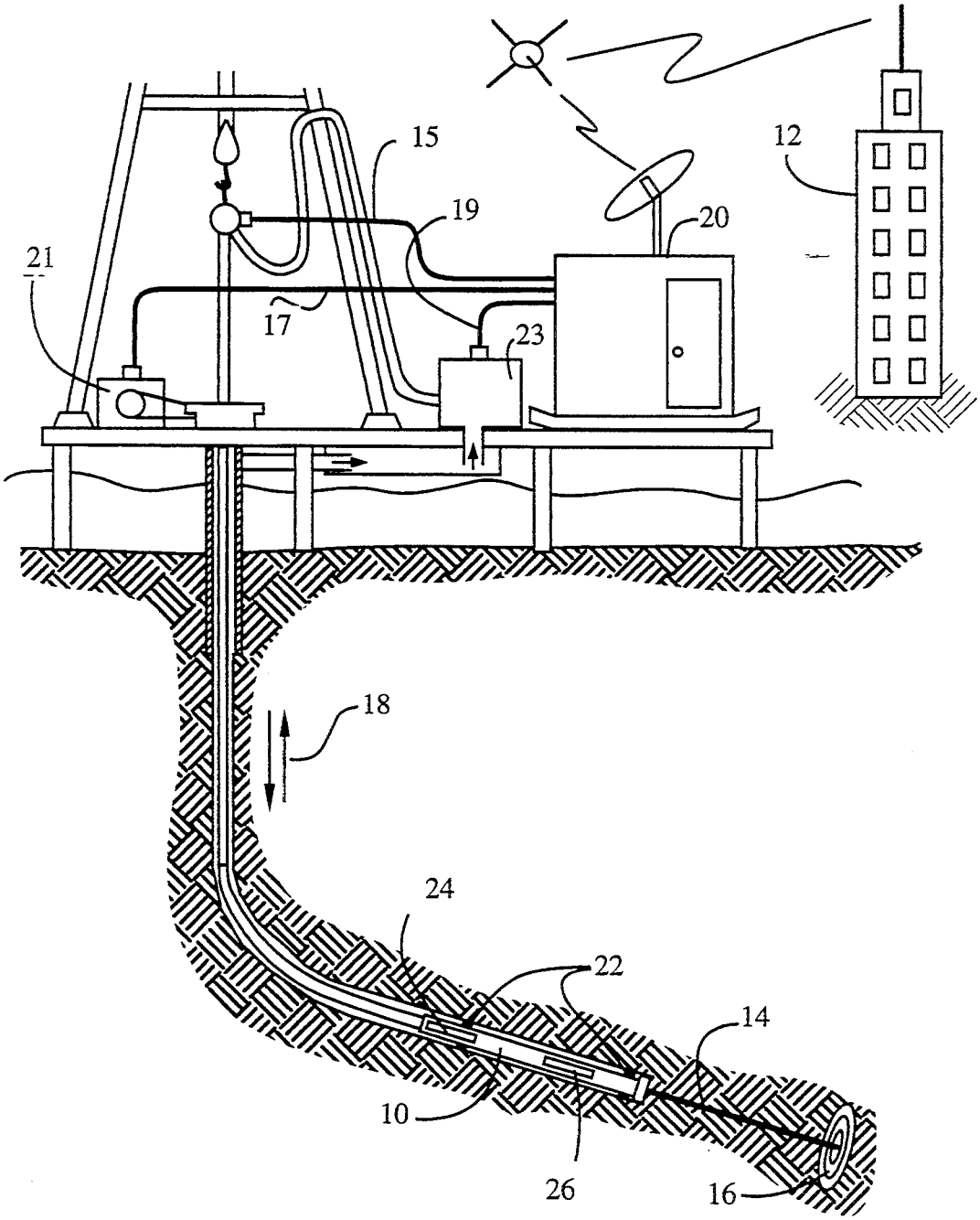
FIG. 1 is a conceptual view of a drilling system employing the automated drilling system of the present invention.

FIG. 1 illustrates an overview of the automatic directional rotary drilling system employing the non-rotating controllable stabilizers of the present invention comprising a downhole drilling system 10 which can be automatically controlled from a remote location, such as an operator's office 12. The system is capable of automatically rotary drilling a high quality borehole accurately along a three-dimensional well profile plan illustrated generally by reference number 14. The plan loaded into the system at the surface, to control the system from spud point to target 16 without any additional information, instructions or control being necessary. A complete 2-way real time communication system 18 between the downhole DRD drilling assembly 10 and the surface control center 20.

The surface control center 20 and the operator's offices 12 have real time 2-way communication via telephone, radio, or satellite providing the operator the ability to monitor and control the drilling operation from his office. Consequently, much information about the drilling operation and the formation being drilled are available real time at the surface and in the operator's offices 12. Surface managers, using this information as an aid, may, if desired, communicate 2-way real time 18 with the downhole system giving it new data or operating instructions. For example, if for any reason, a sidetrack is desirable, the surface manager could communicate downward to the system a new well profile sidetrack plan and the system would automatically drill the new plan.

The automatic self-guiding rotary drilling assembly 10 is equipped with non-rotating controlled stabilizers 22 to affect the directional control, as will be discussed in greater detail below. The drilling assembly also contains directional survey, drilling, and formation sensors 26 and a wire retrievable and replaceable package 24. The package 24 allows larger quantities of data to be exchanged between the surface and downhole than the real time system can support. The 2-way real time communications 18 is accomplished by an upward communication channel 15, commonly called MWD, and two downward communications channels 17, controlled rotary speed 21, and 19, controlled mud pump speed 23. Both the upward channel and the downward channels are well known in the art of measurements-while-drilling, MWD. U.S. Pat. No. 3,789,355 teaches a upward communications system and U.S. Pat. No. 3,800,277 teaches downward channels.

Physical Basis of Directional Drilling

In conventional rotary drilling in order to cut, the bit must be pushed against the formation. The total "push" is a vector force, f, and comes from several sources. The primary contribution is usually the "weight-on-bit", a compressional force that pushes the bit ahead, mostly in the direction of the existing path. These compressional forces normally originate in the weight of drill collars in largely vertical portions of the hole.

There are also forces that are perpendicular to the bit axis (shear forces). Many of these arise from the mechanical interaction of the BHA (bottom hole assembly) and the borehole. For example, in a non-vertical hole the weight and flex of collars can be combined with appropriately sized and spaced stabilizers to add either a "high-side" or "low-side" force. Likewise, a bent sub may produce a perpendicular force in almost any angle of rotation around the borehole axis depending on its geometrical relationship to the existing borehole and its orientation.

The net penetration-rate vector is the result of many factors including: 1.) The direction of the bit and the directional cutting preferences of the bit (the bit anisotropy) 2.) The force vector (direction and magnitude) 3.) Formation effects, both formation anisotropies and bedding-plane to bit-face interactions 4.) Others, such as the cleaning efficiency due to the mud flow rate, etc.

If the formation can be considered isotropic over the interval of interest and the other factors (item 4) remain constant, then the penetration rate will be proportional to a bit anisotropy tensor times the force vector.

$$\vec{p} \alpha E.\vec{f} \tag{1}$$

In the bit-axis coordinate system, the bit anisotropy tensor can be expressed in the form:

$$E = C \cdot \begin{bmatrix} \sigma & 0 & 0 \\ 0 & \sigma & 0 \\ 0 & 0 & 1 \end{bmatrix} \tag{2}$$

where $\sigma$ is the ratio of cutting efficiency to the side to that along the rotating axis and C is a constant.

Figure 2:
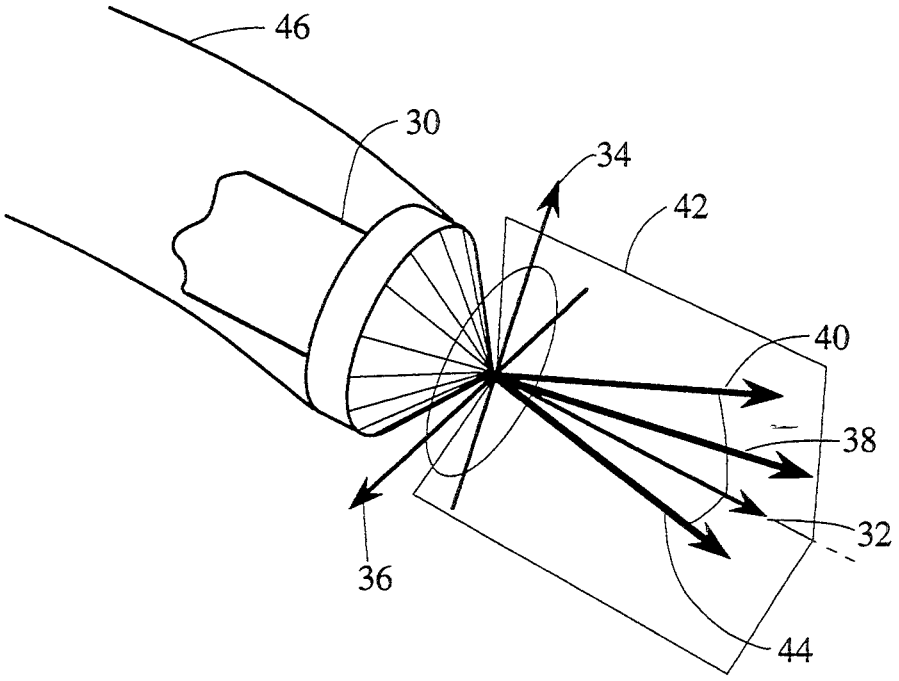
FIG. 2 is an illustration of the high, right and ahead coordinate system used in describing downhole processes.

This case is illustrated in FIG. 2. The directions are shown in the downhole coordinate system for the bit 30 itself. The axis of rotation of the bit forms the "ahead" direction 32; "high" 34 is perpendicular to the "ahead" direction and lies in the vertical plane (or the north plane if the bit axis is vertical); the "fight" axis 36 is perpendicular to the other two in the fashion of a standard fight-handed coordinate system. The direction of the penetration rate 38 is not in the direction of the bit axis 32, nor in the direction of the force 40, but will lie in the same plane 42 that they define; for $\sigma < 1$, it will lie between them. In the general case where formation effects are included, it may not be coplanar. A tangent line 44 to the existing borehole 46 is not necessarily in the same direction as any of these.

There are at least two factors which can be controlled or modified, that have reasonably predictable consequences on the borehole path: the magnitude and orientation of a shear force on the bit 30, and the direction of the bit.

Shear Force Method of Directional Control

Figure 3A:
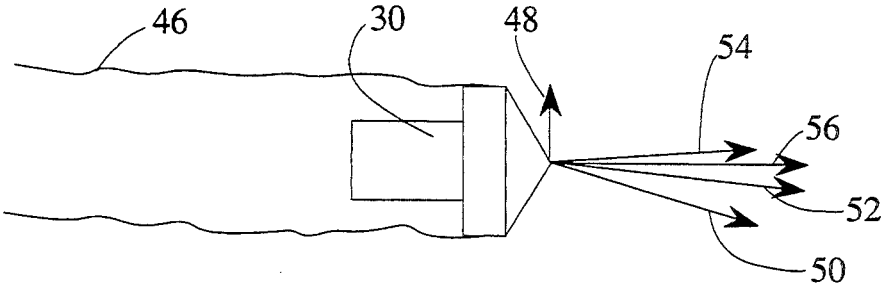
FIGS. 3*a*–3*b* are illustrations of controlling the direction of penetration of the bit by adding a shear force and changing the direction of the bit.

FIG. 3*a*, drawn in a plane view, shows the bit 30 in the borehole 46. The force on the bit without modification 50 plus the formation effects cause the resulting penetration vector 52 to be in a direction other than the desired one. By forcing the bit to the side of the hole, hence adding a shear force 48, the force on the bit can be modified as shown by modified force vector 54 such that the formation effects produce the desired penetration direction 56.

Steering Method of Directional Control

Figure 3B:
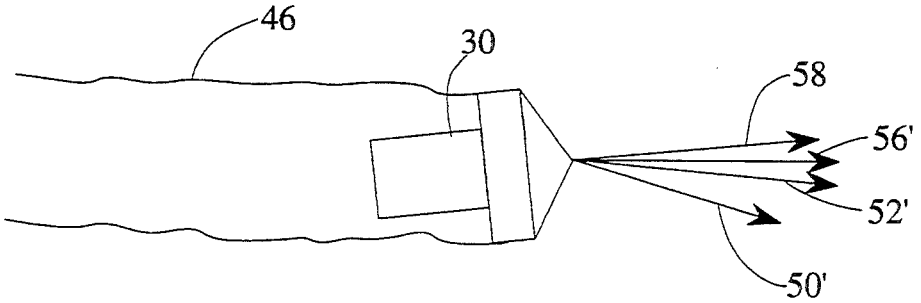

Similarly, as shown in FIG. 3*b*, the bit 30 lying normally in the borehole 46 and the force on the bit 50' result in the wrong penetration direction shown by vector 52'. By changing the direction of the axis of rotation of the bit 30 to a suitable direction 58, the final penetration 56' can be adjusted to the desired result.

Directional Rotary Drilling System

The primary advantage of the present invention is to provide complete directional control while using the conventional rotary drilling method and without restrictions to the normal high efficiency of the rotary method. High quality straight and directional drilling is accomplished without trips to change equipment for directional purposes.

Figure 4:
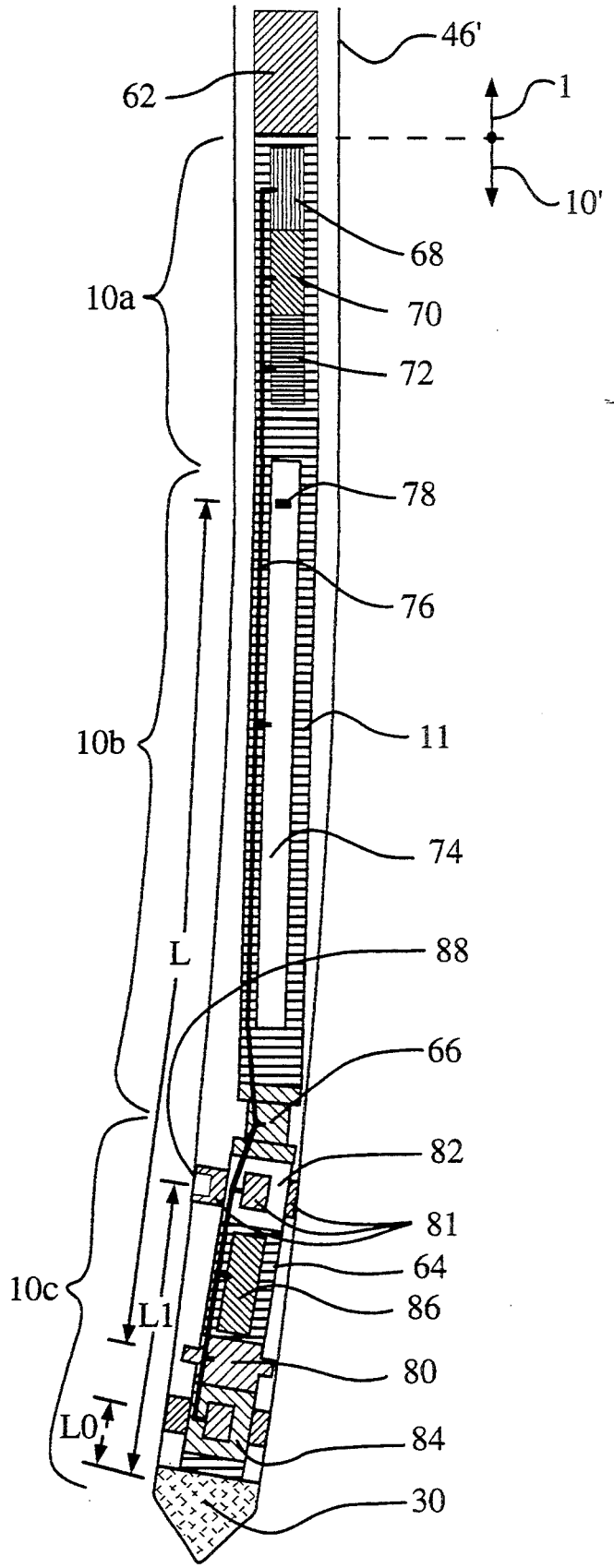
FIG. 4 is an illustration of a composite Directional Rotary Drilling system in the borehole.

FIG. 4 is an illustration of the directional rotary drilling system 10' in a curved borehole 46'. Above the dashed line standard components 1 of a rotary drilling system are shown including drill collars 62 and stabilizer 64. The special directional system components are shown below the dashed line and are generally non-magnetic to avoid magnetic interference with the directional sensors. The upper portion above compliant sub 66 is basically an enhanced MWD system which is divided into two sections, 10*a* and 10*b*. The uppermost section 10*a* composed of stored data 68, MWD transmitter 70, and a power source 72 is retrievable by wire line without removing the drill string. The retrieval process may be carried out to obtain high quality data, repair or replace the transmitter, or repair or replace the power source. The lower section 10*b*, including the central system 74, is not retrievable. The central system 74 includes full data acquisition and processing capabilities, communications management, data storage such as the well plan to be drilled, processing algorithms, and data sensors. A power and data bus 76 connects between all downhole components. A necessary sensor is a full directional survey package which may also serve as magnetic sensors 78 to activate the magnetic marker 80. The distance L between the magnetic sensors 78 and the marker 80 is accurately known to provide accurate downhole incremental depth measurements.

The compliant sub 66 and below provides the mechanical control of direction of penetration of the drill. The compliant sub 66 which is preferably instrumented to measure the weight-on-bit (WOB) torque-on-bit (TORQ) and bending allows making the direction of the bit to be different than the borehole or drill string. The controllable stabilizers 82 and 84 are used primarily to control the angle of the bit and/or the shear force on the bit by controlling the adjustable eccentricity 81, either of which can control the direction of drilling of the bit 30. The near-bit sensors 86 may include formation logs such as gamma-ray, resistivity, density, and porosity. Other desirable sensors include mud resistivity, temperatures and mud pressures inside the collars and in the annulus. The depth wheel 88 and marker 80 provide downhole incremental depth important in calculating the drilled well profile.

Directional Control Via Non-rotating Controllable Stabilizers

The term "controllable" means that elements of the stabilizer can be varied such as to affect the direction of penetration of the bit, principally through modifying the direction of the bit and/or the shear force on the bit. Several different methods of achieving this control by controlling the eccentricity of the rotary drill pipe in the borehole are described below. In all cases, the eccentric portion of the stabilizer does not rotate which allows the eccentricity to be oriented and cause the drill to penetrate in the direction desired. The non-rotation feature prevents significant wear of the formations by the stabilizer, an important benefit.

The two geometric terms, curvature and tool face orientation, define the directional properties of a borehole at any given depth and are critical to the following discussions. Curvature is the degree of bending or turning of the borehole and usually has the units of degrees/100 feet or degrees/10 meters. Tool face orientation is the clockwise angle from the high side reference in the ahead, high and fight downhole coordinate system, FIG. 2. The degree of curvature and its tool face orientation are functions of and can be controlled by the degree of eccentricity of the rotating drill bit in the borehole and its tool face orientation.

The various stabilizer methods will be discussed in order of their functional performance level.

Single Non-rotating Eccentric Offset with Controllable Direction

Figure 5A:
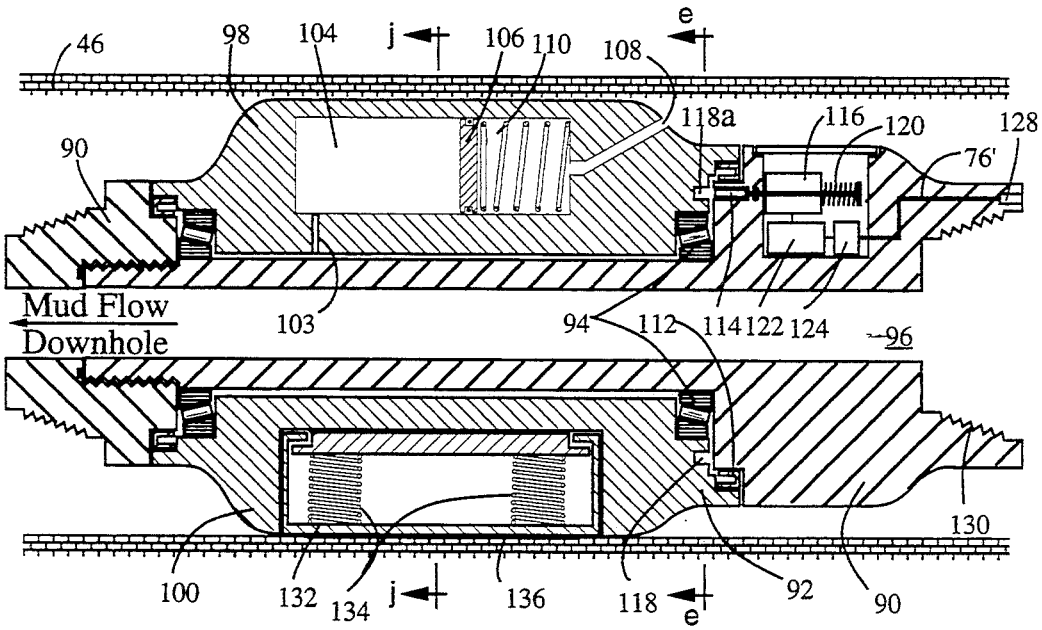
FIGS. 5*a*–5*e* is an, illustration of a controlled offset stabilizer using a single, non-rotating, eccentric offset with controllable direction.
Figure 5B:
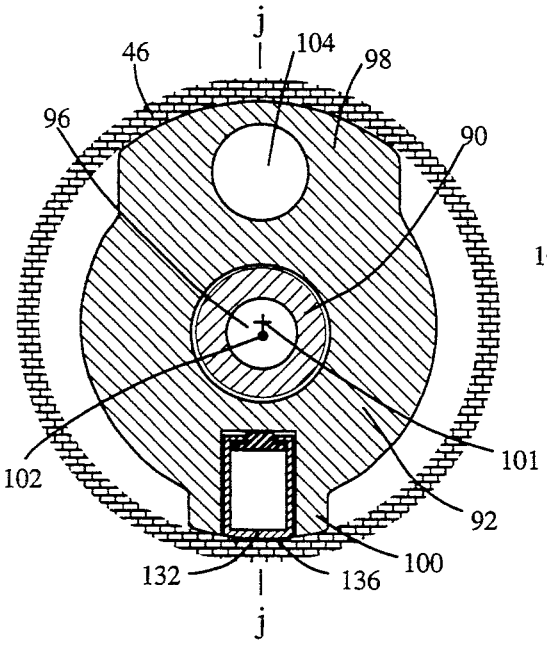
Figure 5C:
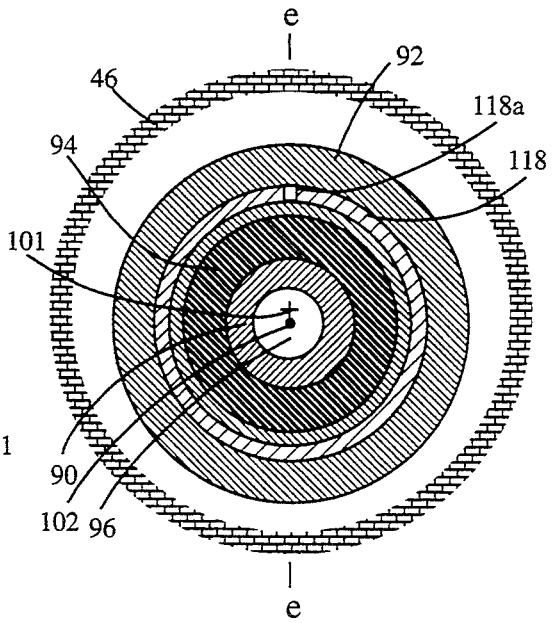

FIG. 5*a* is a cross section along the borehole axis of a single eccentric controllable stabilizer in the borehole 46. The rotating drill collar assembly 90 is held in the non-rotating section 92 by bearings 94. FIGS. 5*b* and 5*c* are cross sectional views at points j and e perpendicular to the axis of the borehole. Drilling mud flows down through a conduit 96 inside the rotating collar. The large vane 98 and the smaller vane 100 position the center of rotation 102 eccentrically off the center of the borehole 101. The direction of the eccentric offset is opposite vane 98. Hydraulic fluid supplied by connection 103 from hydraulic pressure compensator 104 fills the volume between the sections 90 and 92 providing lubrication and exclusion of contaminants. Piston 106 transmits the annulus mud pressure supplied by channel 108 to the hydraulic fluid contained in the chamber of compensator 104. Compression spring 110 adds an incremental pressure above the annular mud pressure. Seals 112 prevent flow of mud in or hydraulic fluid out.

The non-rotating eccentric elements 92, 100, and 98 are a single structure which is positioned by latch 114. This is accomplished by activation of solenoid 116 driving the latch 114 into recess 118 where it rotates until it engages the eccentric driver 118*a* protruding into recess 118 and rotates the eccentric to the desired orientation when the solenoid power is terminated and spring 120 withdraws latch 114 leaving the eccentric in the desired orientation. The driver 118*a* is affixed to the eccentric in a precisely indexed position such as the point of maximum eccentricity. The solenoid is powered by power supply 122 which is controlled by the bus interface 124. Bus 76' supplies power and control signals. Connector 128 connects the bus 76' to the bus in other sections of the system. A special tool joint 130 connects the various modules of the system.

Articulated vane 132 is loaded by springs 134 forcing cutters 136 to cut small grooves into the formation thus preventing rotation of the system. This antirotation method is further described below and shown in FIG. 9. The spring loading allows the cutters to retract during the positioning process. The correct orienting information supplied in the following manner. The directional drilling algorithms in the central processor calculate the desired Tool Face Orientation (TFO) for the eccentric to drill in the desired direction. The directional sensor package measures the TFO of the rotating system continuously and, via the bus, signals the solenoid interface 124 at the exact moment to withdraw the latch 120 leaving the eccentric section 98 at the desired TFO. Because the eccentric does not rotate, this process of orienting the eccentric need be done only infrequently.

This system allows direct control of the tool face orientation (direction) of the eccentricity of the rotating drill bit within the borehole; consequently, the tool face orientation of the curvature of the borehole being drilled is controllable.

Single Non-rotating Eccentric with Controllable Eccentricity and Direction

Figure 5D:
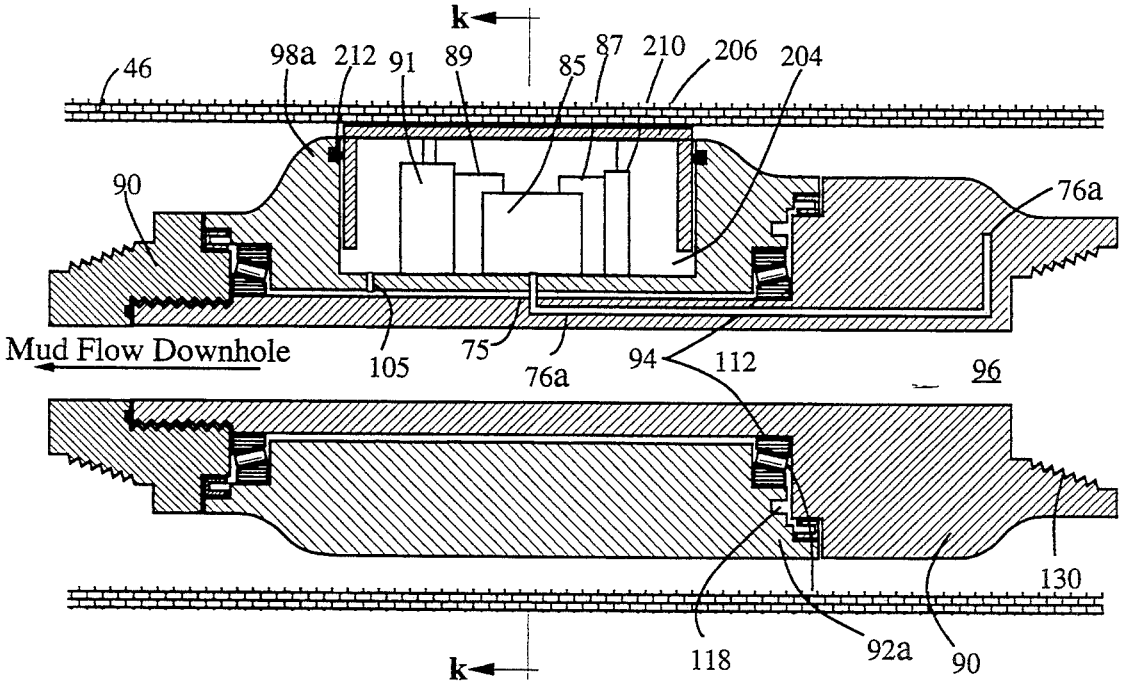
Figure 5E:
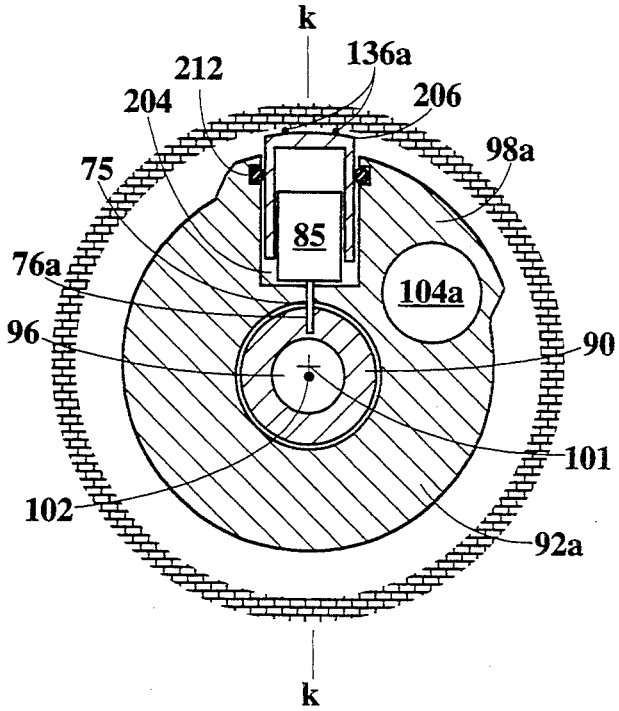

FIGS. 5*d–e* illustrates a controllable stabilizer utilizing a single eccentric with separately controllable tool face orientation and eccentricity. Tool face orientation control is the same as described above and shown in FIGS. 5*a–c*. The degree of eccentricity is controlled from zero to a maximum value by means of movable vane element 206 contained in the vane cavity 204 within the larger portion 98*a* of the non-rotating element 92*a*. The vane cavity 204 is pressurized by hydraulic fluid supplied by compensator 104 in FIG. 5*a* via inlet 105 and is isolated from the annular drilling mud by seals 212. Power and data bus 76*a* which is an extension of bus 76' in FIG. 5*a* supplies power and control signals to interface 85 via the slip ring connector 75 between rotating element 90 and the non-rotating element 92*a*. Interface 85 receives the movable vane 206 extension position from position sensor 210 via connection 87 and relays it to the central processor via bus 76*a*. The central processor calculates any desired change in the movable vane 206 position and relays the necessary information back to the interface 85 via bus 76*a*. Interface 85 then energizes the vane mover 91 via connection 89 causing the vane 206 to move to the desired position. This process of monitoring and adjusting the movable vane position to the desired value is continuous. Through this process of adjusting the movable vane position, the degree of eccentricity of the drill bit in the borehole is controlled; consequently, the degree of curvature of the borehole is controlled. Both hydraulic and mechanically operated movable vane mechanisms are described in detail below and are illustrated in FIGS. 7*a–d* and FIG. 8.

This single eccentric non-rotating stabilizer with controllable eccentricity and tool face orientation can effectively control the three-dimensional path of the borehole.

Dual Eccentric Stabilizer with Controllable Eccentricity and Direction

FIGS. 6*a–e* illustrate a dual eccentric stabilizer composed of a rotating element 90' and three non-rotating elements: a concentric outside vane assembly 92' which is supported by the borehole 46 in a non-rotating fashion, an outer eccentric 152, and an inner eccentric 150 which supports the rotating element 90' through bearings 94'. The volume around the eccentrics and bearings is pressurized with hydraulic fluid supplied by pressure compensator 104' which is supplied with mud pressure through channel 138 or 108' as controlled by valves 142. Compression spring 110' in conjunction with piston 106' creates a hydraulic fluid pressure above the inside mud or annulus mud pressure chosen by valves 142. The seals 112' isolate the hydraulic fluid and the mud.

The eccentricity of the rotating element 90' with respect the the borehole 46 is controlled solely by the orientations of the two eccentric elements 150 and 152. The orientation of outside vane element 92' has no effect on the eccentricity because it is concentric within itself. This vane element 92' is held in a non-rotating position within the borehole 46 by multiple vanes and anti-rotation devices 136' described below and shown in FIG. 9.

Figure 6A:
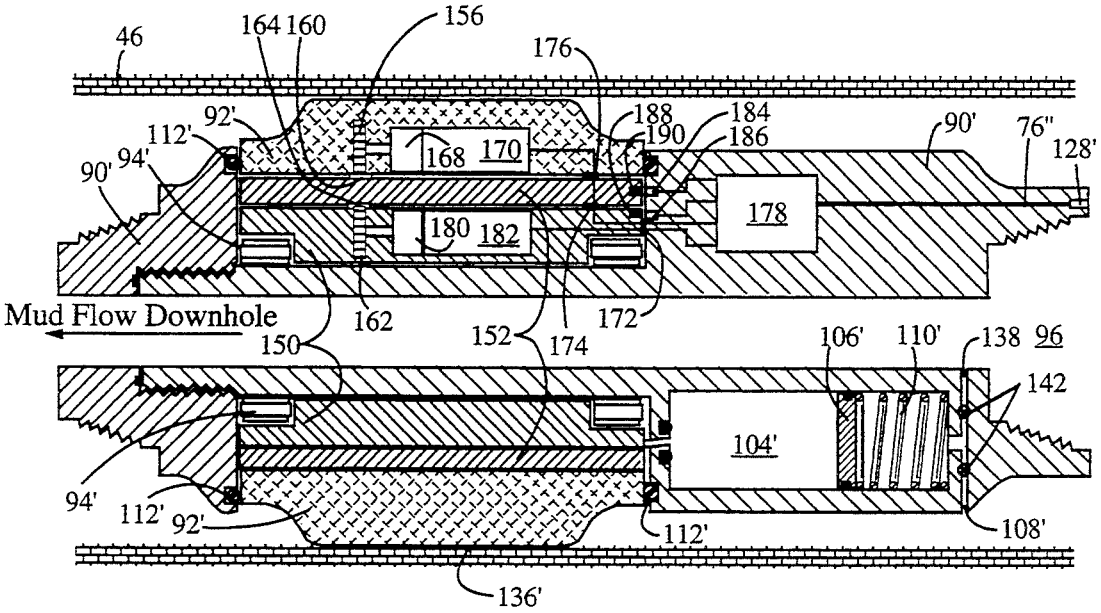
FIGS. 6*a*–6*e* is an illustration of a controlled offset stabilizer using a non-rotating section comprised of a symmetrical vane element and two eccentric elements which are actively positioned to control the direction and value of eccentricity.
Figure 6B:
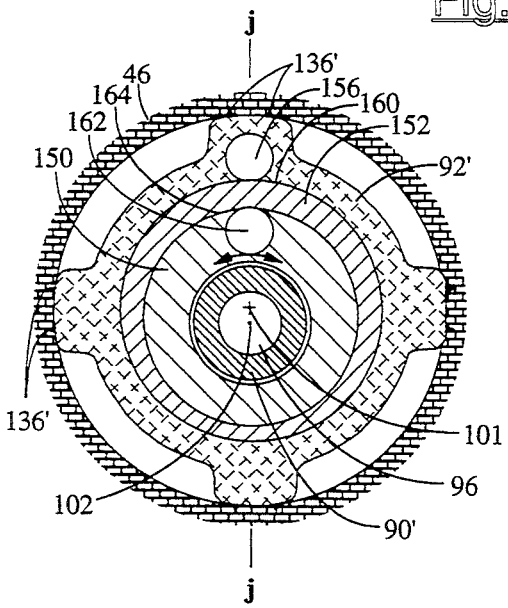
Figure 6C:
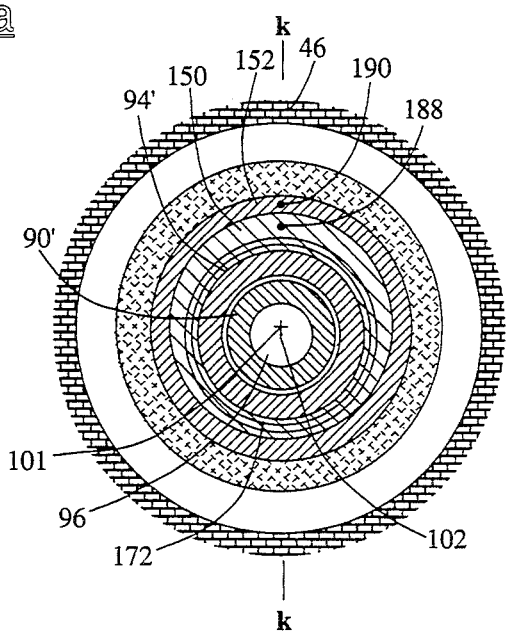
Figure 6D:
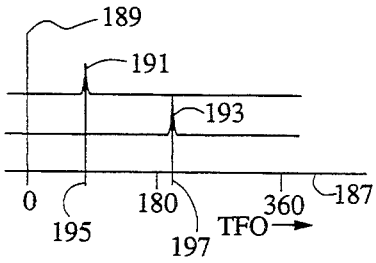
Figure 6E:
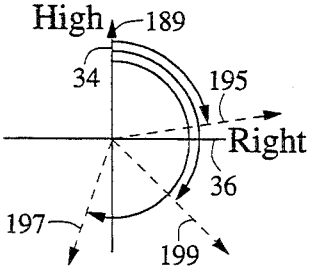

The outer eccentric 152 is oriented to any desired TFO by operation of gear 156 which is affixed to the outside vane element 92', as shown in FIG. 6*a*. Gear 156 meshes with ring gear 160 teeth not shown which is affixed to and completely around outer eccentric 152. Similarly, the inner eccentric 150 may be oriented to any TFO by operation of gear 162 which is affixed to eccentric 150. Gear 162 meshes with ring gear 164, teeth not shown, which is affixed to and completely around the inside of outer eccentric 152.

When gears 156 and 162 are not operating, the three non-rotating elements 150, 152 and 92' are locked in fixed relative orientation with respect to each other by the enmeshed gears 156, 160, 162, and 164 and, consequently, their TFOs are constant also because vane element 92' is held in non-rotation via the vanes and anti-rotation devices 136'. The resulting eccentricity can be observed in FIG. 6*b* and c where the cross 101 is the center of the borehole and the center 102 of the rotating element 90 is displaced from this center 101. Gear 156 is driven by gear reduction train 168 and electric stepping motor 170. Driving pulses for motor 170 are supplied by electrical leads through slip rings 172, 174, and 176 from the bus interface 178. The information for the number of pulses to be supplied is input to the interface 178 through bus 76'' and bus connector 128' from the central processor. Similarly, gear 162 is driven by gear reduction 180 and electric stepping motor 182. Driving pulses for motor 182 are supplied by electrical leads through slip ring 172 from the bus interface 178. Similarly, the number of pulses is supplied by the central processor through the bus system.

Definitions and Mathematical Relations

The following analysis applies to the case of the preferred embodiment wherein the eccentricity of the two eccentrics is equal although the invention is not so limited. The governing equations are:

$$TFO=(TFO_o+TFO_i)/2 \quad (3)$$

$$E=E_o\cos((TFO_i-TFO_o)/2 \quad (4)$$

$$TFO_o=TFO-\cos^{-1}(E/E_o) \quad (5)$$

$$TFO_i=TFO+\cos^{-1}(E/E_o) \quad (6)$$

$$N_o=k_i(TFO_o-TFO_o\text{ desired}) \quad (7)$$

$$N_i=k_o(TFO_i-TFO_i\text{desired}) \quad (8)$$

Where:

TFO = the effective orientation of the net eccentricity $E_o/2$ = the eccentricity of each eccentric E = the effective net eccentricity $TFO_o$ = the Tool Face Orientation of the outer eccentric $TFO_i$ = the Tool Face Orientation of the inner eccentric $N_o$ = number of pulses sent to outer drive motor $N_i$ = the number of pulses sent to the inner drive motor $k_o$ = the angular rotation of the outer eccentric per pulse $k_i$ = the angular rotation of the inner eccentric per pulse Detailed Eccentric Orientation Procedure The starting point for this discussion is that the central processor has already determined the desired $TFO_o$ and $TFO_i$ values such that the remaining task is to set these values into the controlled stabilizer. Referring the FIGS. 6*a* and *c*, Magnetic detectors 184 and 186 mounted in the rotating element 90' each produce a pulse as they are rotated by the magnets 188 and 190 mounted in the outer eccentric 152 and the inner eccentric 150 at the orientation of maximum eccentricity of each eccentric. The occurrence of each pulse is transmitted by the bus interface 178 through the bus 76'' to the central processor where a comparison is made with the TFO information also coming in over the bus from the directional sensor package. The actual existing $TFO_i$ and $TFO_o$ are thus determined. The central processor compares these actual TFO values with the desired values and calculates $N_i$ and $N_o$, the number of stepper motor pulses needed to correct the TFOs to desired values. These values of $N_i$ and $N_o$ are transmitted over the bus system to the bus interface 178 which then sends $N_i$ and $N_o$ to stepper motors 182 and 170, respectively. The motors then orient the eccentrics to their exact desired orientation as described above. The magnetic detectors 184 and 186 continuously monitor the TFOs. No further orientation action is normally required until the desired values of TFOs are changed or after long drilling has resulted in some creep in orientation of the non-rotating vane element 92' has occurred.

FIGS. *6d* and *6e* illustrate setting the TFOs to desired values from initial values 189 of zero illustrated in FIGS. *6a–c*. FIG. *6d* which illustrates the orienting magnetic pulses 191 and 193 has a linear TFO scale 187 from 0 to 360 degrees and FIG. *6e* is the high 34 and fight 36 plane of the high, fight, ahead coordinate system described in FIG. 2 wherein TFO is measured clockwise from high which is zero. The outer eccentric is rotated to a $TFO_o$ desired 195 of 80 degrees and the inner eccentric is rotated to a $TFO_i$ desired 197 of 200 degrees. Equation (3) and (4) are used to verify an effective TFO desired 199 of 140 degrees and an effective eccentricity $E=0.5\ E_o$.

Hydraulic Stabilizer with Multiple Independent Vanes

FIGS. *7a–d* illustrate a multi-vane stabilizer with independent hydraulic control of each vane. This method provides full control of the following parameters: (1.) magnitude of eccentricity, (2.) direction of the eccentricity of the rotating element with respect the borehole, (3.) setting of the size of the stabilizer to fit tightly in the borehole, (4.) recording of a precision caliper log as drilled, and (5.) direct control of the shear force on the bit and, alternately, the shear force to weight-on-bit ratio. FIGS. *7a–d* includes a compliant sub element 66' along with allied strain measuring sensors 198 and 200 which will be discussed separately below.

Referring to FIGS. *7a–c*, the non-rotating element 92" contains in chambers 204*a–d* movable vanes 206*a–d* hydraulically controlled to individually press against the borehole 46 causing element 92" to be positioned eccentrically within the borehole as desired.. Rotating element 90' is held in the same eccentric position as element 92" by bearings 94". Each vane 206*a–d* is equipped with a position sensor 210*a–d* which enables exact individual placement of each vane. Seals 212*a–d* ensure pressure tight compartments 214*a–d* between vanes 206*a–d* and vane cavities 204*a–d*. Hydraulic lines 218*a–d* supply individually controlled hydraulic fluid to the compartments 214*a–d*. Tension springs 216*a–d* retract the vanes 206*a–d* to minimum extension which is within the cavities 204*a–d* when the hydraulic pressure in compartments 214*a–d* is minimized providing protection during tripping. The volume 236 between elements 92" and 90" is filled with pressurized hydraulic fluid supplied through duct 220 and sealed in by seals 112'. Incremental depth is provided by a depth wheel insert 202 into vane 206*a*. Magnetic detector 221 detects the depth indicating magnets in wheel 88'. Depth measurement is described separately, below.

Magnetic detector 226 detects the passing of position indexed magnet 228 providing precise orientation (TFO) of the non-rotating element 92". Pressure sensors 230 and 232 provide inside mud pressure 96 and internal compartment 236 pressure respectively, and are connected to the bus system via interface 201. Pressure sensor 234 provides the annulus mud pressure and is connected to the bus system via data acquisition system 282 and bus interface 280. Strain sensor 200 provides torque on the drill bit. Strain sensor 198 provides both weight-on-bit and bending which is convertible to both bend angle and shear force on the drill bit. Sensor 238 provides mud resistivity data. Power and data bus 76" is connected to other modules through connector 128' and between the rotating element 90" and non-rotating element 92" by interface 242 which can be common slip rings. Network 244 distributes electrical and hydraulic lines between areas of the module. Hydraulic and electronic equipment are housed in compartments 246. Sealed and pressure proof covers 248 provide environmental protection for the equipment.

FIG. *7d* shows more detail of the servo controlled hydraulic operations. There are four basic units; a source of pressure compensated hydraulic fluid 250, a source of high pressure hydraulic fluid 252, a hydraulic control package 254, and a smart servo controller 256. Unit 250 consists of annulus mud 258 and spring 110" acting on sealed piston 106" produces hydraulic fluid. 104" pressure compensated slightly above the annulus mud pressure. This higher fluid pressure increases seal life by reducing the entrance of mud abrasives into the seals. Conduit 266 supplies hydraulic fluid to unit 252 which consists of an electrically driven hydraulic pump 268 and a high pressure accumulator 270. Conduit 272 supplies high pressure hydraulic fluid to hydraulic control unit 254 which meters the hydraulic fluid individually to the conduits 220 and 218*a–d*. Conduit 276 returns surplus hydraulic fluid to the input of pump 268. Unit 256 is an electronic processor which contains three sections; a bus interface unit 280 which interfaces via bus 76" with the central processor, a local data acquisition and processing unit, and a servo controller unit 284. A bundle of conductors 286 connects servo controller 284 to the hydraulic controls. Conductor 288 supplies power to the hydraulic pump motor. A bundle of conductors 290 from the data acquisition section 282 accesses the sensors as shown by the conductor numbers. Pressure sensor 230 and 232 data are received through bus 76".

Example Control Processes

To caliper the borehole: 1.) central processor instructs unit 256 to caliper via bus 76". 2.) Servo controller sets modest and equal hydraulic pressure in all vane control conduits 218*a–d*. 3.) Data acquisition unit 282 reads the vane position sensors 210*a–d* and transmits data to central processor via bus 76". 4.) Central processor calculates the caliper (borehole size) using stored algorithms and stabilizer parameters. To drill a given curvature in a given direction using steering method: 1.) The TFO of the non-rotating element 92" is measured by comparing the signal from sensor 226 as magnet 228 passes with the directional sensors. 2.) The central processor calculates the required eccentricity and direction. 3.) Using the TFO, eccentricity, and direction; the central processor calculates all vane positions required and transmits them via bus 76" to the electronic processor unit 256. 4.) The servo controller 284 meters hydraulic fluid via conduits 218*a–d* until the vane position sensors 210*a–d* read the desired values sent by the central processor. To drill a given curvature in a given direction using shear force method: 1.) Determine TFO as above. 2.) Central processor calculates shear force to weight-on-bit ratio required to drill desired curvature using stored bit anisotropy tensor and any available formation anisotropy information. 3.) Servo controller sets vane pressures 218*a–d* to obtain measured shear force to weight-on-bit and TFO as calculated. Shear force is dynamically controlled to be compatible with weight-on-bit controlled from surface. To drill a long distance straight ahead in unknown formations: 1.) Caliper the borehole as above. 2.) Set vanes to hole size with zero eccentricity. 3.) Drill ahead collecting and analyzing directional survey data. 4.) If and when significant directional departure from straight is observed, central processor calculate, using either the shear force method or the steering method or a combination, vane parameters designed to drill a curvature equal and opposite the observed departure from straight ahead thus compensating for natural properties. 5. Drill and observe and as necessary reiterate the above process.

Mechanical Vanes

Figure 8:
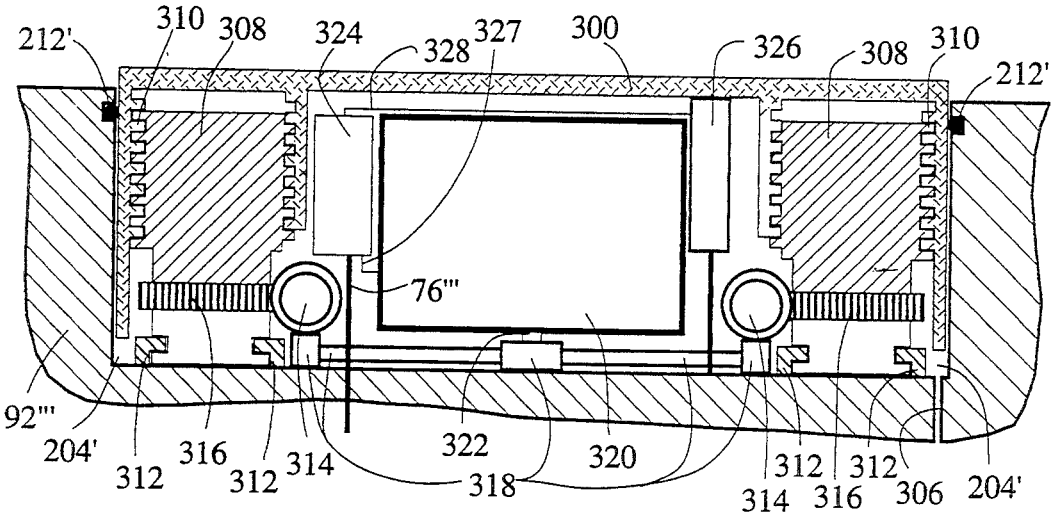
FIG. 8 is an illustration of a mechanically operated vane which may be substituted for the hydraulic operation in FIGS. 7*a*–7*d* to accomplish similar functions except the control of the force on the vanes.

Mechanically operated vanes are substituted into non-rotating element 92''' in place of the hydraulically operated vanes described above. The same basic functions, magnitude and direction of the offset, size or caliper of the vanes, and force on the vanes are controlled. FIG. 8 shows a cross section through a mechanical vane along the axis of the borehole the same as in FIG. *7a* of the hydraulic system. Movable vane 300 is sealed to vane cavity 204' by seal 212' identical to the hydraulic system. Cavity 204' is filled with hydraulic fluid via duct 306 which is pressure compensated slightly above the pressure of the annulus mud for greater seal life and minimum interference with mechanical operation.

Heavy duty screws 308 have mating threads 310 with the vane 300 and are held with virtually no translation possible by clamps 312. The screws 308 are free to rotate about an axis parallel with threads 310 and are induced to do so by rotation of worm gear 314 which engages with ring gear 316 which is integral with screw 308. Gear 314 is rotated by means of drive train 3 18 when stepper motor 320 rotates shaft 322. The drive train is arranged such that gears 308 turn in the same direction when motor 320 rotates shaft 322. The mechanical vane is operated by information supplied from the central processor via bus 76''' and bus interface 324. The central processor has stored in its memory the factor relating the number of pulses required to move the vane an exact distance. The central processor also keeps track of where the vane is at all times so that to obtain any other position the central processor need only calculate the required sign, vane in or out, and number of pulses and transmit them over the bus 76''' to interface 324. The interface then sequences that number of power pulses with proper sign and power level through lead 327 to the stepper motor 320. The vane extension force is a function of pulse power level used; maximum power is used when power level is not specified.

A vane 300 position sensor 326 is also included and maybe used to check the vane position. This check is accomplished by interface 324 reading the value of the position sensor 326 through lead 328 and transmitting it over bus 240 to the central processor where it is compared with the existing processor value.

Example Control Processes

The mechanical vanes function with rather close analogy to the hydraulic vanes; consequently, the following examples illustrate processes wherein functional differences are largest. The following examples assume a controllable stabilizer similar to the hydraulic system of FIG. 7 except for the substitution of mechanical vanes. To caliper the borehole: (1.) Central processor transmits caliper command and caliper pulse power level to interface 324 via bus 76'''. (2.) When caliper process is finished, Interface 324 transmits vane position sensor 326 data to central processor via bus 76'''. (3.) central processor calculates caliper from sensor 326 data and stored parameters and resets vane position memory to sensor 326 value. (In step 2 the caliper process used the following operations: (a.) interface 324 issues a preset small number of full power retraction pulses insuring vane size less than borehole size. (b.) interface 324 issues a continuous string of the specified power level extension pulses until sensor 326 reaches a constant value when caliper process is finished.) To drill a given curvature in a given direction using shear force method: (1.) Determine TFO as above in hydraulic system. (2.) Central processor calculates shear force to weight-on-bit ratio required to drill desired curvature using stored bit anisotropy tensor and any available formation anisotropy information. Further calculate estimated position required and issue pulse data to interface 324 via bus 76'''. (3.) Interface 324 issue prescribed pulses to vane motors. (4.) In an on-going iterative process, central processor monitors shear force and weight-on-bit sensors and issues incremental correction pulses to interface 324 which are relayed on the vane motors in such a manner as to maintain the prescribed shear force to weight-on-bit ratio and direction. Preparation to trip out of hole. (1.) Central processor issue trip command (2.) Interface 324 issue continuous string of full power retraction pulses until position sensors 326 indicate full retraction of vanes.

Anti-rotation System

Figure 9:
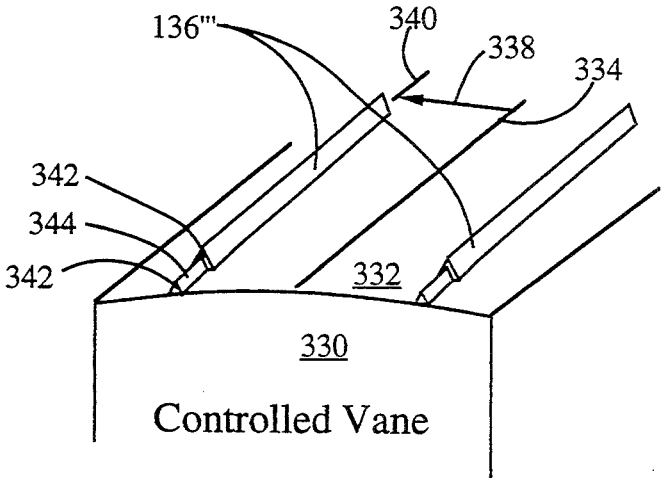
FIG. 9 is an illustration of a modification to the surface of a controlled vane which insures non-rotation of the vane assembly.

The non-rotating controllable stabilizer system requires that any rotation of the non-rotating element be at a rate lower than the systems ability to update the effective orientation of the system's eccentricity. The frictional drag of smooth faced vanes is normally sufficient to create an acceptably slow rotation or creep but may be insufficient under severe drilling conditions. FIG. 9 is an illustration of an improvement to the face of the vane in contact with the borehole which provides positive control of rotation. Reference numeral 330 is the downward edge and 332 is the face which presses against the borehole wall. Line 334 on the face of the vane 332 is parallel with the axis of the borehole. Knives 136''' serve two basic functions: (1.) to cut a groove in the borehole face and (2.) follow in the groove. The knives are mounted on the face of the vane substantially parallel with the axis of the borehole as shown by the angle 338 between line 334 and a line 340 representing the axis of the knife. In the absence of torque, the knives should follow precisely in the groove cut by the leading edge 342 in which case the vane will rotate in proportion to angle 338. When angle 338 is zero and the torque is zero, the vane should not rotate. In the practical world of severe drilling conditions, a small angle 338 may be used to counter any creeping tendency. The actual construction of the knives can take many forms. A very simple form is to braze onto the vane face a long thin bar of tungsten carbide with a triangular cross section. In harder formations, the leading edge 342 of such a knife could be faced with a polycrystalline diamond to improve the cutting and wear characteristics. In even tougher conditions, the size of the knife could be progressively increased from a small section 344 to a maximum in a series of steps where each step in size is faced with a special cutter such as the polycrystalline diamond.

Downhole Depth

Directional survey data and the borehole depth are necessary to the process of calculating the well profile. In normal directional drilling practice using MWD, the directional survey data are taken downhole against a clock and telemetered to the surface where the surface depth is recorded against the clock. The two clock referenced measurements of depth and directional data are combined to produce depth referenced directional survey data. In this invention, the hole profile is calculated downhole; consequently, both directional survey data and corresponding depth are required downhole at the time of well profile calculation. Several methods of obtaining downhole depth are described below.

Download Surface Depth

Surface depth can be downloaded to downhole system via the surface-to-downhole communication link. To meet the requirements of downhole well profile calculation, the surface depths which correspond with the depths of the directional sensors at the time all surveys used in the well profile calculation were taken must be downloaded. A typical operation would be to stop drilling approximately every 31 feet to add a joint of drill pipe and while stopped take surveys and record the surface depth at the same time. The surface depth just recorded is the surface measurement of the bit depth and is corrected for directional sensor offset from the bit before telemetry downhole where it is matched with the appropriate directional survey data. This downloaded surface depth is equivalent in accuracy to the standard surface calculation method and is adequate for downhole well profile calculation.

Downhole Incremental Depth

Although the downloaded surface depth is adequate for the purpose of well profile calculation it has two major drawbacks as the only source of depth information downhole. The surface-to-downhole communication link has a very low channel capacity, thus it is inconvenient and expensive to send the required amount of data. Important uses for downhole depth data other than well profile calculation require much higher resolution and higher quality depth data. Higher resolution and quality is needed but the standard of surface measured depth is important to maintain. Both of these criteria are met by downloading the surface measured depth infrequently and adding to it downhole incremental depth measurements made downhole. The equation for the downhole measured depth is:

$$MD = MD_s + ID \tag{9}$$

where:

MD—downhole measured depth $MD_s$—downloaded surface measured depth

ID—integral downhole measured incremental depth since last $MD_s$ download

Three methods of obtaining MD are described below.

Magnetic Marker

FIG. 4 shows magnetic marker assembly 80 spaced at a precisely measured distance L from magnetic sensors located uphole.

Figure 10B:
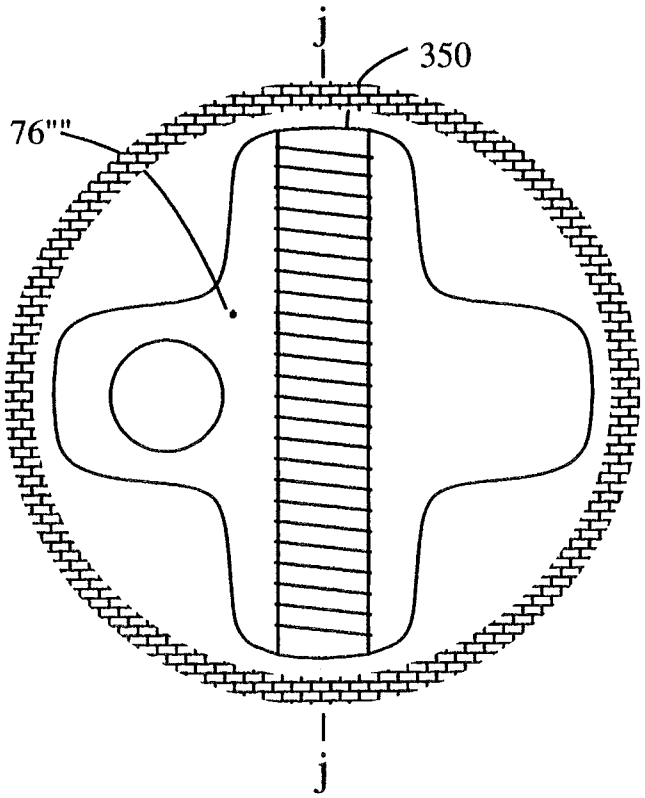
FIGS. 10*a*–10*b* is an illustration of a magnetic marker assembly used to magnetically mark the borehole wall at measured depth intervals thus providing a method of accurate downhole incremental depth measurement.
Figure 10A:
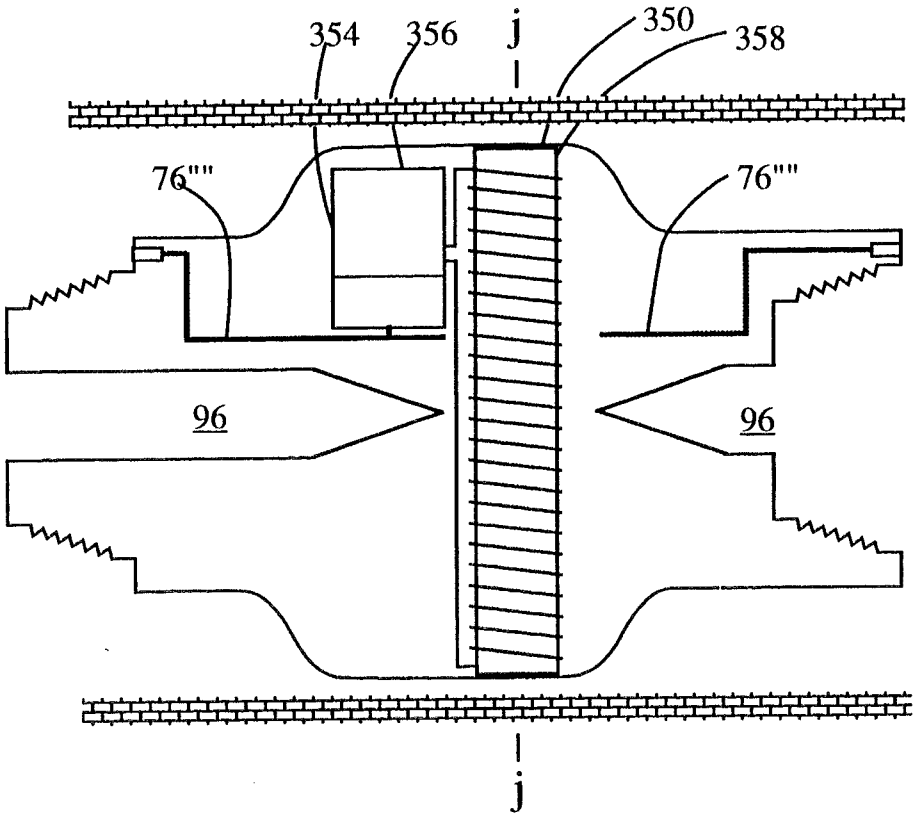

FIGS. 10*a–b* illustrates the details of the marker 80. A formation magnetizer 350 is built into the marker assembly 80 which also contains a power and data bus 76''''. Interface 354 receives information and power from the bus 76'''' and manages the magnetizer driver 356 which supplies current to coil 358. Magnetizer 350 is constructed of high permeability magnetic material. Current flow through coil 358 causes the magnetizer 350 to be magnetized with magnetic poles at its ends which have an intensity dependent on the value of the current. The downhole mud flow is through channel 96 which diverts from the center around the magnetizer.

Figure 11A:
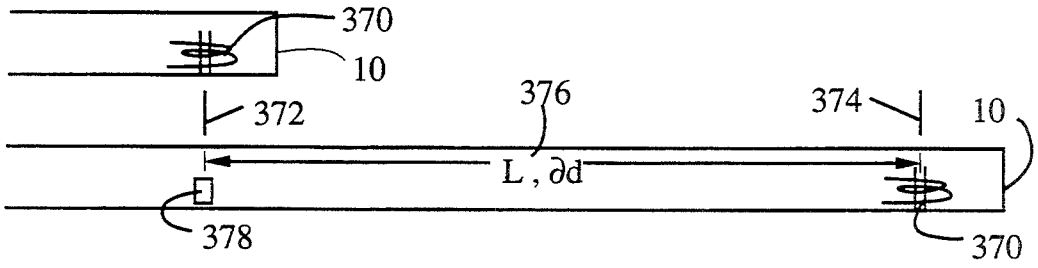
FIGS. 11*a*–11*b* is an illustration demonstrating the principles of operation of the magnetic marker downhole incremental depth measuring method.

FIG. 11*a* illustrates the magnetic marking process and how precise depth increments are obtained. Reference numeral 370 represents the location of the magnetizer 350 in the downhole system 10. Mark 372 was created in the formation by a current pulse through the magnetizer when the system was in the position shown in the upper portion of the illustration and mark 374 was created later when the system had advanced an incremental distance 376. The incremental distance is shown as L in FIG. 4 and ∂d in FIG. 13*a*.

Figure 11B:
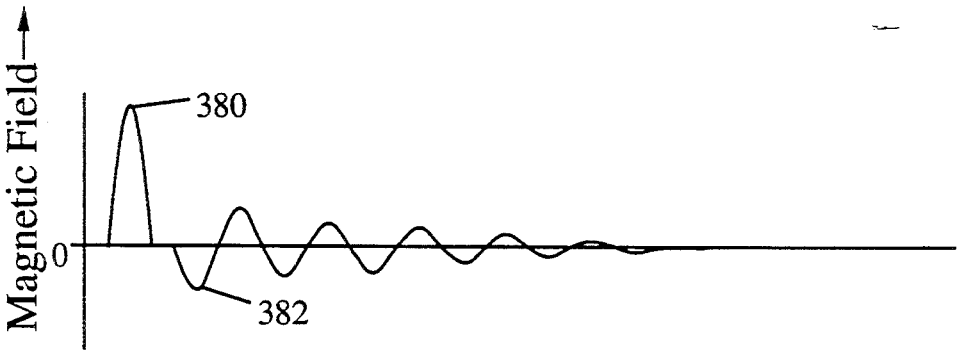

Precise spacing of the distance L between the marks is accomplished by using the magnetic sensors 378, spaced a distance L from the marker, to detect the passing of mark 372 and immediately signaling via the central processor, bus 76'''' and interface 354 of FIG. 10*a*, to produce another magnetic pulse thus producing mark 374 spaced a distance L from Mark 372. New formation marks are created at incremental distances L on a continuous basis. Rock formations generally have a high magnetic coercivity requiring high intensity magnetic fields for magnetization; consequently, the marker pulse 380 shown in FIG. 11*b* has a high intensity of a few thousand oersteds at the pole faces. Although there should be no other significant magnetic materials nearby in the DRD system, a demagnetizing wave 382 follows the marker which serves a magnetic cleaning function. This demagnetizing wave has an initial current magnitude substantially smaller than the marker pulse thus leaving the formation magnetized while demagnetizing the much lower coercivity magnetic materials of the marker assembly and any surrounding DRD system components. The magnetic cleaning wave 382 has a decaying amplitude function as characteristic of demagnetizing systems. The incremental depth resolution of this marker is limited to about one foot to avoid overlapping of the marks.

Figure 7A:
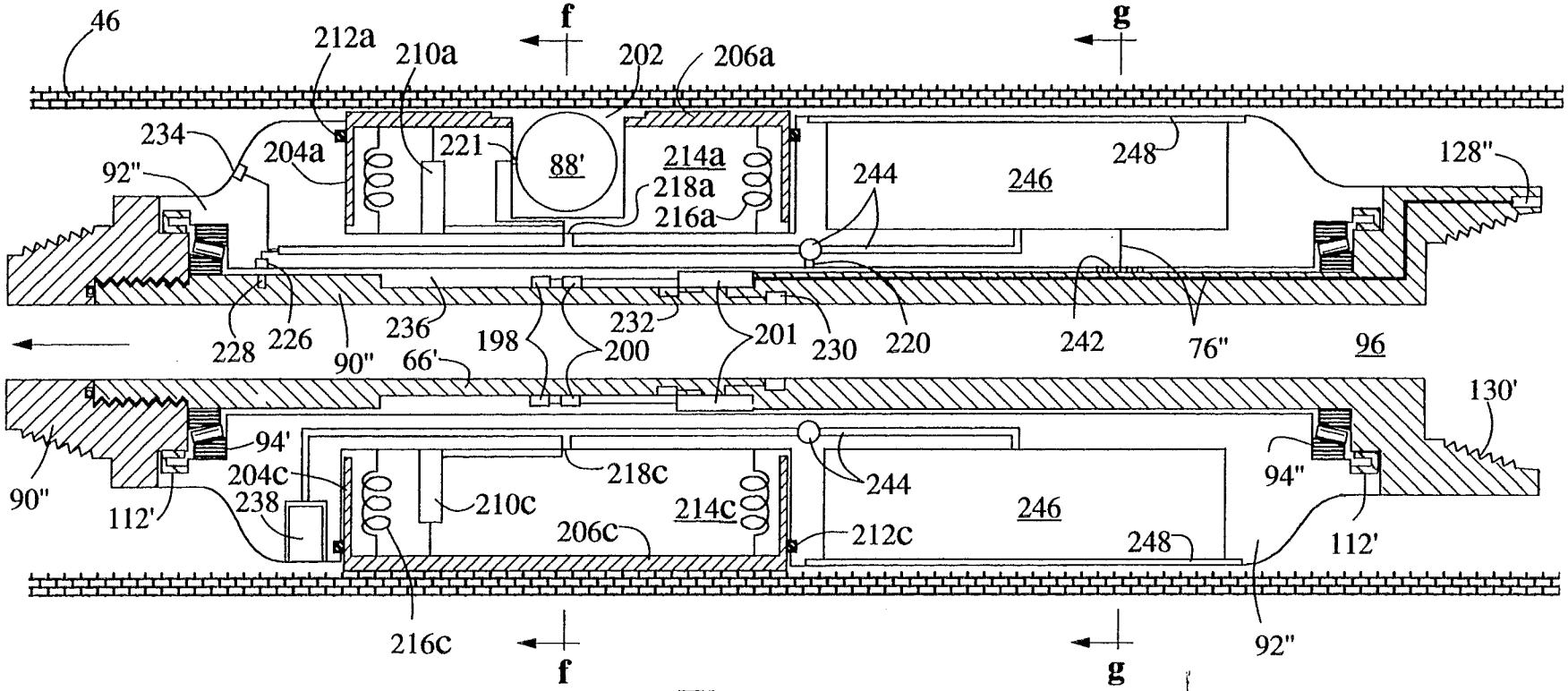
FIGS. 7*a*–7*d* is an illustration of a controlled offset stabilizer which uses hydraulics to control the position of the non-rotating multiple vanes resulting in full control of the magnitude and direction of the offset, size or caliper of the vanes, and force on the vanes.
Figure 7B:
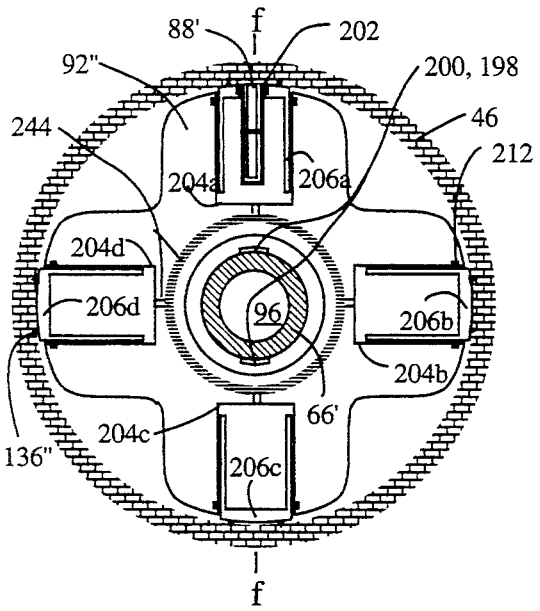
Figure 7C:
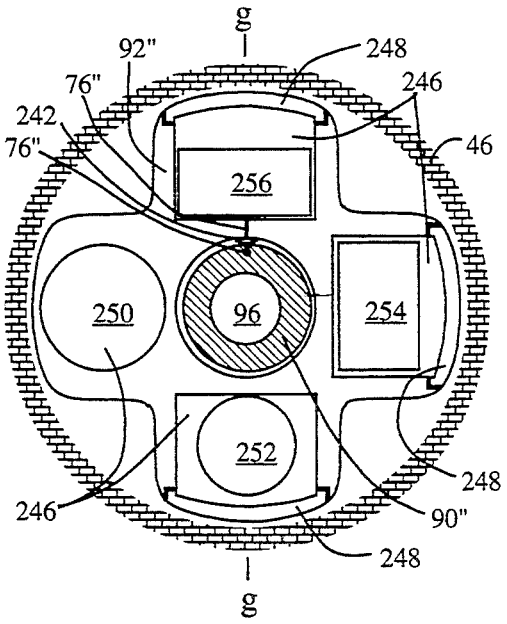
Figure 7D:
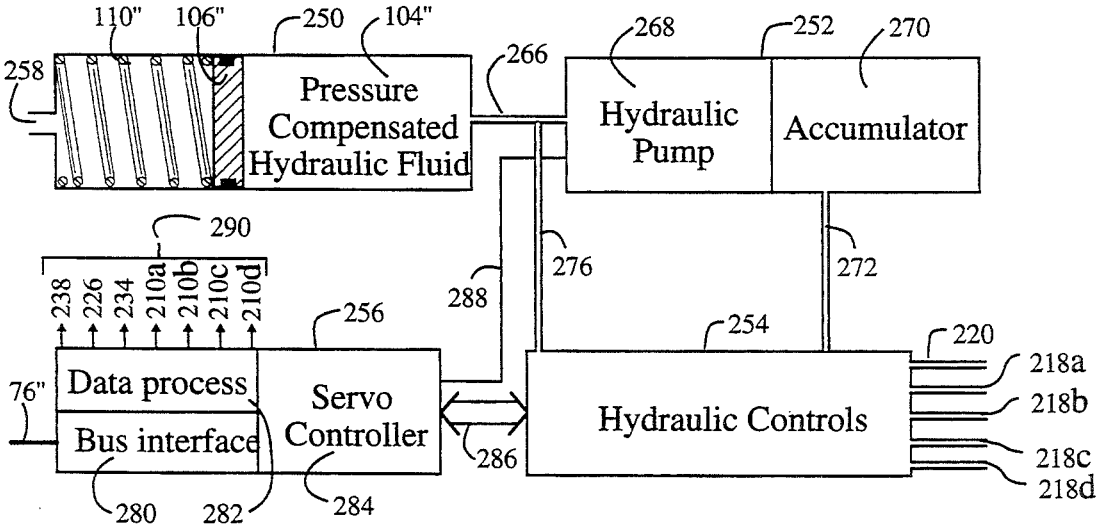
Figure 12:
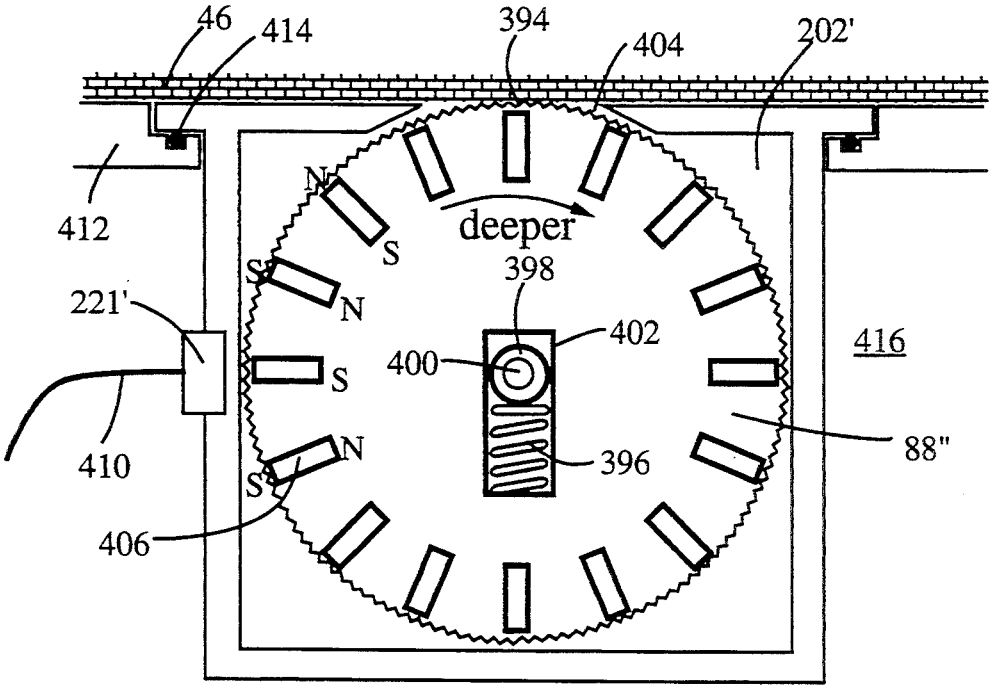
FIG. 12 is an illustration of a depth measuring wheel which provides a method of measuring incremental downhole depth accurately and with high resolution.

Depth Wheel The depth wheel system shown in FIG. 12 is, in one embodiment, an insert 202' which fits into a vane of a non-rotating stabilizer such as shown by 202' in FIG. 7*a*. The depth wheel 88' in FIG. 12 is completely enclosed within insert 202' except for a small area through which the depth wheel protrudes to contact the formation 46 at point 394. The depth wheel is pressed firmly against the borehole by means of spring 396 through bearing 398 and the axle 400 of depth wheel 88'. Depth wheel 88' is constrained to move only in a direction perpendicular to the borehole by caging mechanism 402. The rim 404 of the depth wheel 88' which contacts the borehole 46 is constructed to roll on the borehole surface with a constant rolling circumference; that is, without variable slippage. In the preferred embodiment of this rim 404, the surface consists of very hard, fine, sharp teeth which run parallel with the wheel axis and have a curvature which matches the borehole. These teeth embed slightly into the borehole providing a substantially constant rolling circumference of the depth wheel. Another means of accomplishing a constant rolling circumference is a sharp abrasive particle coating on rim 404.

Depth changes are measured by detecting the passing of magnets 406 by the detector 221'. Electrical leads 410 connects detector 221' to suitable circuitry or bus interface. Detector 221' is composed of multiple magnetic detectors arranged to unambiguously detect depth changes in either deeper or shallower directions. One method for such unambiguous detection is shown in U.S. Pat. Nos. 4,114,435 and 4,156,467 which contain a method of encoding borehole depth at the surface location of the well. The magnets 406 are an even number of magnets closely spaced with alternating pole signs. Magnet spacing smaller than one-half inch can be reliably detected providing a depth resolution of one-half inch or less. The depth wheel insert 202' is sealed into the stabilizer vane 412 by means of seal 414 thus maintaining isolation of the interior 416 of vane 412.

Figure 13A:
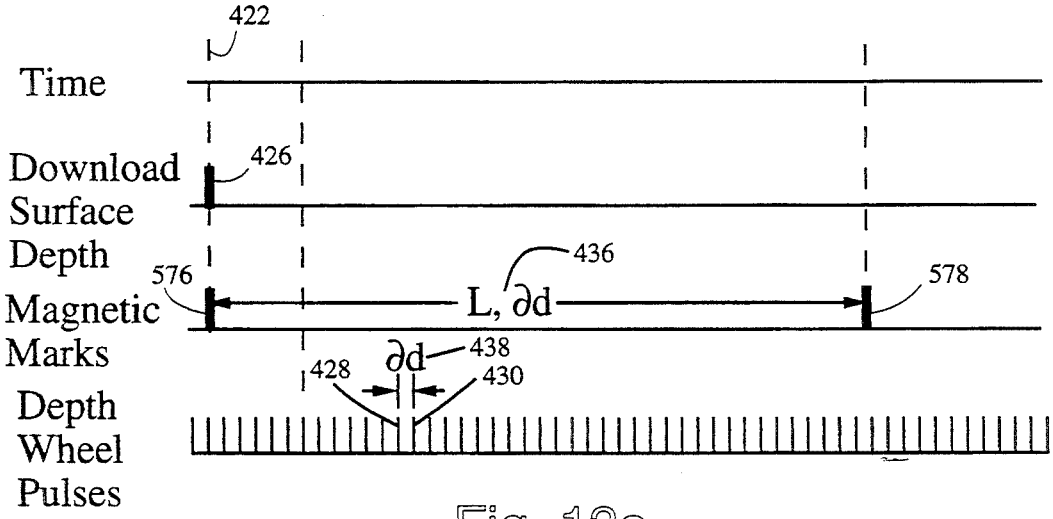
FIGS. 13*a*–13*c* is an illustration which shows the principles of operation of the downhole depth system including surface depth download, incremental depth addition, and the combined operation of the magnetic marker and the depth wheel.
Figure 13B:
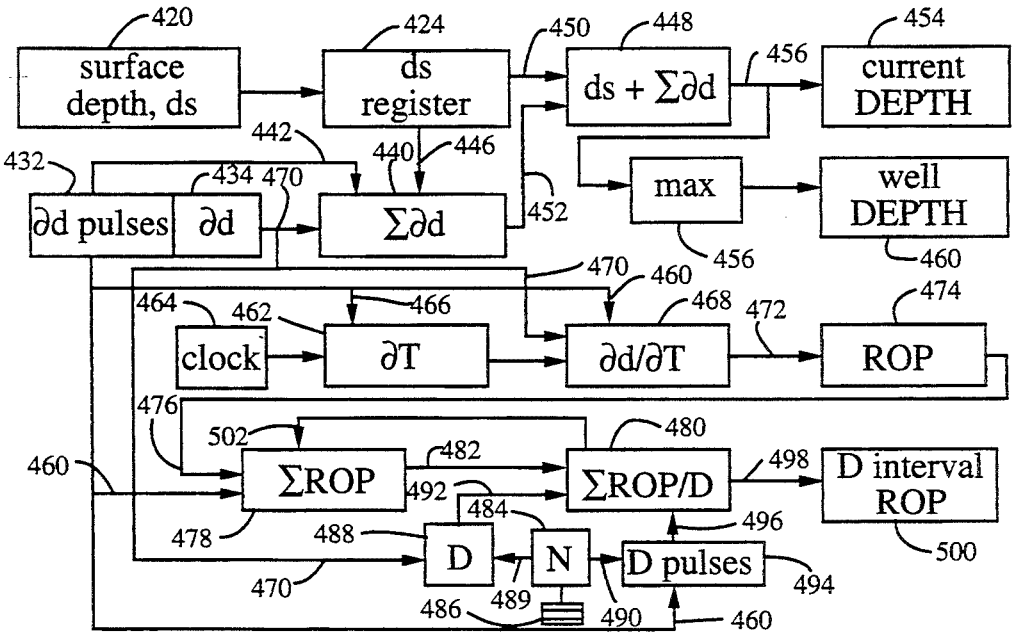
Figure 13C:
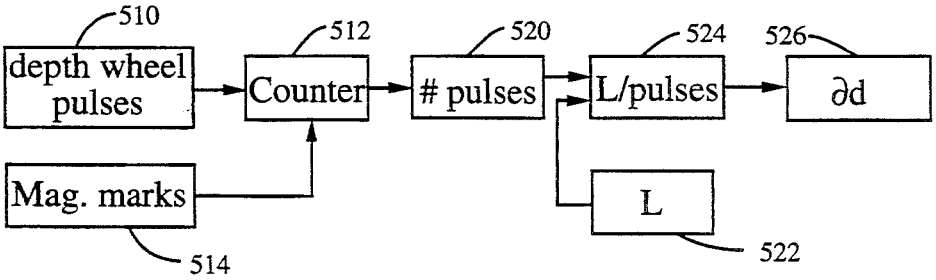

Surface Depth Download, Marker, and Depth Wheel Operations FIGS. 13*a–c* illustrates the relationship of the three components of downhole depth; surface depth download and two sources of incremental downhole depth, namely, magnetic mark pulses and depth wheel pulses. The surface depth 420 is downloaded at time 422 into surface depth register 424 as indicated by the download pulse 426. In the following description, either the magnetic mark pulses 576, 578 . . . or the depth wheel pulses 428, 430 . . . are the source of the ∂d pulses 432. ∂d 434 is the known or calibrated distance between either the magnetic mark pulses 576 and 578 shown by 436 or the depth wheel pulses shown by 438. A method of calibrating ∂d for the depth wheel pulses is shown in FIG. 13*c* and will be described below.

The output register of summation circuit 440 increments by a depth amount plus or minus ∂d 434 when a ∂d pulse 432 is received via 442 in accordance with the sign of the ∂d pulse received. Summation circuit 440 output register is reset to zero via 446 each time the surface depth is downloaded; consequently, the current value of the incremental depth since the last surface depth download is contained in the summation circuit 440 output register. Adder 448 sums the value of the last downloaded surface depth 424 received via 450 and the value of the incremental depth since the last download of surface depth 440 received via 452 to obtain the value of the current depth which is sent to the current depth register 454 via 456. The current depth of the drill bit is contained in register 454 at all times. Maximum value circuit 456 extracts the maximum value of the current depth received via 456 which is routed to well depth register 460 as the Total Well Depth known as TD. Adder 462 accumulates incremental time by summing high speed pulses received from clock 464. ∂d pulses sent via 466 cause adder 462 to output the incremental time between ∂d pulses, ∂T, to divider 468 and reset to zero. ∂d pulses received via 460 cause divider 468 to divide the value of ∂d received from ∂d 434 via 470 and output the ratio, ∂d/∂T, via 472 to the ROP register 474 as the Rate-Of-Penetration, ROP, of the drill. This ROP is for the smallest increment of depth, ∂d, just completed.

The value of ROP in register 474 is routed via 476 to ROP adder 478. ∂d pulses via 460 cause the ROP adder 478 register to increment by the value of ROP. The summation of ROP in register 478 is routed to the ROP filter 480 via 482. The value of an adjustable integer 484, N, is set by control 486. Depth interval 488 calculates the depth interval D by multiplying the value of ∂d received via 470 by the value of N received via 489. The value of D is routed to ROP filter 480 via 492. Depth interval pulses 494 which mark the boundaries of the depth interval D are calculated by dividing ∂d pulses received via 460 by the integer N received via 490.

The depth interval pulses 494 are routed via 496 to ROP filter 480. ROP filter 480, upon receiving a depth interval pulse 494, divides the value of summed ROP received via 482 by the value of the depth interval D received via 492 to produce an average value of ROP over the depth interval D. The average ROP is output via 498 to the D interval average ROP register 500 and a pulse is sent via 502 which resets ROP adder 478 to zero. The specific technique of averaging ROP discussed in not intended to limit the method but merely illustrate the method.

FIG. 13*c* illustrates a method of downhole calibration, or verification, of a downhole incremental depth measuring system by another. The specific example illustrated is the calibration of the high resolution depth wheel shown in FIG. 12 by the high accuracy magnetic marker system shown in FIGS. 10*a–b* and FIGS. 11*a–b*. In FIG. 13*c*, Depth wheel pulses 510, examples shown in FIG. 13*a* by 428 and 430, are counted by counter 512. Magnetic mark pulses 5 14, examples shown in FIG. 13*a* by 576 and 578, cause counter 512 to forward the current pulse count to pulse count register 520 and to reset to zero. Register 522 stores the accurately known distance L between the magnetic marker and the magnetic mark sensor shown by 436 in FIG. 13*a* and illustrated in FIG. 4. The ∂d generator 524 calculates ∂d, the distance between ∂d pulses, by dividing the distance L received from register 522 by the number of depth wheel pulses received from count register 520. ∂d generator 524 forwards the value of ∂d to the ∂d register 526. The value of ∂d in register 526 is one source for the value of ∂d used in FIG. 13*a* ∂d 434.

Compliant Sub and Strain Sensors

The compliant sub is a specially engineered section of the drill collar with generally reduced cross sectional area to provide desired bending (change of direction) and measurement of mechanical strains. Measurement of the mechanical strains, combined with knowledge of the parameters of the system, allows the calculation of critical directional drilling parameters: 1.) the ahead force on the bit (weight-on-the-bit), 2.) the shear (side) force on the bit, 3.) the total angle of bend and its direction, 4.) the relative penetration rate of the bit ahead and to the side (curvature of hole) and the direction (of curvature), and 5. ) the rotary torque on the bit.

Figure 14A:
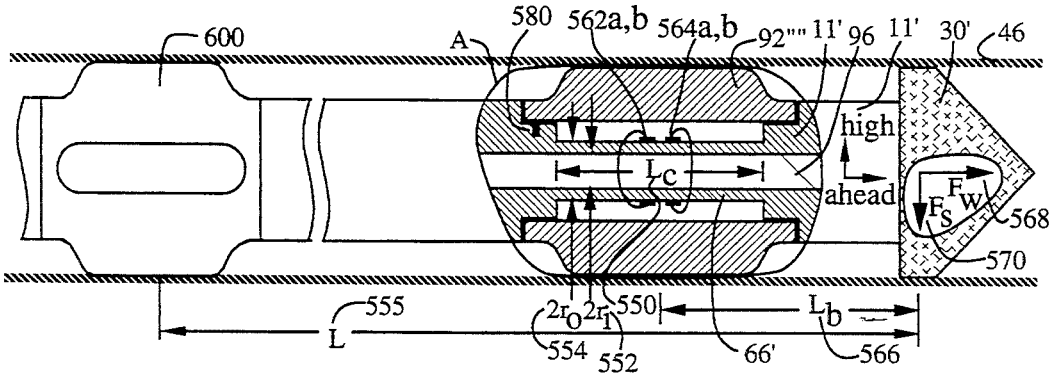
FIGS. 14*a*–14*e* is an illustration of a drilling system utilizing a compliant sub instrumented to measure the ahead and shear force with TFO on the bit, the bending of the compliant sub, and the torque on the bit.

The compliant sub may be engineered for optimal performance at any one or combination of these measurements. The compliant sub may optionally be combined with other elements such as a non-rotating stabilizer as is shown in FIG. 7*a*. FIGS. 14*a–e* illustrates basic parameters and relations of the compliant sub, strain measurement, and calculation of the drilling parameters. FIG. 14*a* illustrates the mechanical layout of a borehole 46 containing rotating drill collar 11' with drill bit 30' attached. Cutout A exposes a cross sectional view of a compliant sub 66' of length 550, Lc, inner diameter 552, 2 $r_i$, and outer diameter 554 2 $r_o$. Drilling mud flows down through the channel 96 in the rotating compliant sub and collar 11'.

Figure 14B:
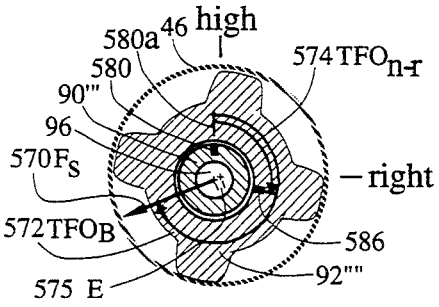

A non-rotating controllable stabilizer 92'''' is used in conjunction with the compliant sub to provide eccentric offset of the sub 66' in the borehole 46. Strain sensor pair 562*a* and 562*b* are mounted parallel to the axis on the indexed high side and low side (180); respectively, of the compliant sub and measure the two surface axial tensional strains. In the same manner, strain sensor pair 564*a* and 564*b*, mounted at 45 degrees to the axis, measure the rotary torques. The distance 566 between the compliant sub 66' and the bit 30', $L_b$, is a design parameter. The total force on the bit is measured and specified with three variables: 1.) the force along the axis of the bit 568, $F_w$, 2.) the shear (perpendicular to axis) force on the bit 570, $F_s$, and 3.) the angle of the shear force 572, $TFO_B$, in its high-right plane shown in FIGS. 14*b, d.* Recall from the description of FIG. 2 that the axis of the bit (down) forms the ahead direction of the ahead, high, and right coordinate system used here. FIG. 14*a* is in the high, ahead plane and FIG. 14*b* is in the high, fight plane. Looking at FIG. 14*b* is equivalent to looking directly down the axis of the drill.

The TFO Domain

Figure 14C:
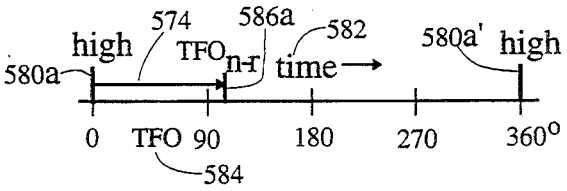

Tool Face Orientation, TFO, is an industry term meaning the clockwise angle from the high axis in the high, right plane as illustrated in FIG. 14*b* by the tool face orientation 574, $TFO_{n-r}$, of the non-rotating element 92''''. The TFO domain illustrated in FIG. 14*c*, and used in FIGS. 14*d* and *e*, is generated in the local processor by means of timing pulse 580*a* transmitted from the central processor via the bus system described in discussion of FIG. 4, the DRD System. The timing pulse 580*a* is incorporated into the local processor clock system coincident with the high side reference indicator 580 on the rotating element 90''' passing the high axis which is defined as TFO=0. FIG. 14*c* illustrates this clock system wherein a timing pulse 580*a* initiates the time scale 582 and the next revolution timing pulse 580*a'* terminates the scale. The scale is convened to a TFO scale 584 by dividing it linearly from 0 to 360 degrees. This TFO domain is used in the local processor to describe the high, right plane angles and phase relationships.

The TFO of the non-rotating element 92'''' is determined by displaying the pulse 586*a* generated by the passing of the rotating element 90''' high side reference magnet 580 by the magnetic detector 586 mounted at its reference location in the non-rotating element 92''''. The non-rotating element 92'''' TFO 574, $TFO_{n-r}$, of approximately 108 degrees is shown in both FIGS. 14*b* and *c*. The local processor has this non-rotating controlled stabilizer 92'''' TFO information which is necessary to controlling the eccentric parameters of the stabilizer previously described in conjunction with the various types of stabilizers.

Figure 14D:
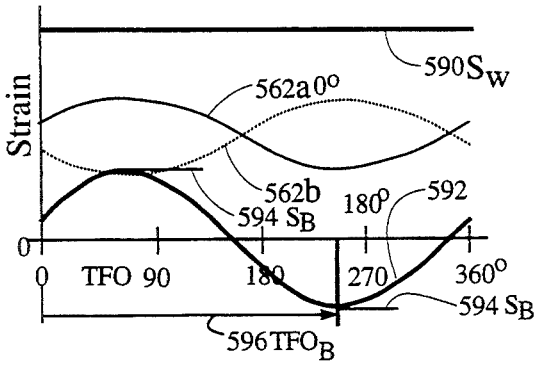
Figure 14E:
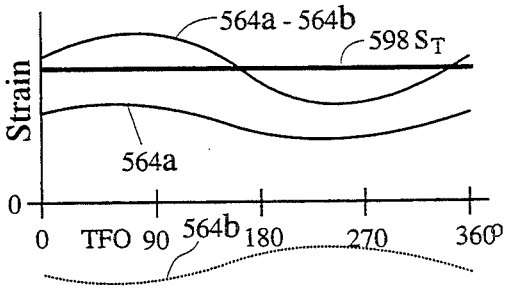

The strain sensors 562*ab* and 564*ab* are mounted on the rotating element compliant sub 66' with the a sensors aligned with the high side and the b sensors aligned at 180 degrees to the high side providing a known phase relationship with the high side. The output of tensional strain sensors 562*a*, mounted at high side, and 562*b*, mounted at 180 degrees from high side, are shown in FIG. 14*d*. The output of torque strain sensors 564*a*, mounted at high side, and 564*b*, mounted at 180 degrees from high side, are shown in FIG. 14*e*. Note again that all strain signals are detected in the TFO domain. In FIG. 14*b*, the bit shear force 570, $F_s$, its TFO 572, $TFO_B$, and the causative eccentricity 575 E are shown.

The Strain Sensor Outputs and Drilling Parameter Relationships

The strain sensors are sensitive to unwanted input strains and do not directly measure wanted drilling parameters. Consequently, it is necessary to protect the sensors from certain unwanted strains, arrange the sensors to enhance some strains while eliminating others, and calculate the desired drilling parameters using mathematical relationships appropriate to the particular system design. The following description is based on the relationships shown in FIG. 14*a* and *b* and the removal of mud pressure effects as described in association with FIG. 7*a*.

Tension-compression sensor relations: FIG. 14*d* illustrates the outputs and relations for the tension-compression sensors 562*a* and *b*. Both weight-on-bit and bending forces cause output from these sensors. True weight-on-bit causes a uniform output in both the a and b sensors which is not a function of TFO. Both a and b sensors have a constant and equal output proportional to weight-on-bit. A simple bend of the compliant sub (fixed in space) causes a compressional strain in the compliant sub on the concave side of the bend and an equal tensional strain on the convex side of the bend. Rotation of the compliant sub while keeping the bend constant in space produces the sensor outputs 562*a* and 562*b* shown in FIG. 14*d*. The strain due to weight-on-bit 590, $S_w$, is obtained by adding the sensor outputs 562*a* and 562*b*. The strain due to bending 592 is obtained by subtracting 562*b* from 562*a* varies with TFO and has a positive and negative peak value 594, $S_B$. The negative strain peak TFO 596, $TFO_B$, is the direction of the shear force 570, $F_s$. The three measured tension sensor parameters $S_w$, $S_B$, and $TFO_B$ are used with the values of the geometrical factors, material properties, and constants to calculate the drilling parameters: (1.) ahead force on bit (weight), $F_w$, (2.) shear force on bit, $F_s$, and its direction, TFOB, (3.) total bend angle of the compliant sub, $\theta_B$, and its direction, $TFO_B+180$, and a hole curvature factor, C, and its direction, $TFO_B$. The equations for $F_w$, $F_s$, $\theta_B$, and C are:

$$F_w=S_wY\pi(r_o^2-r_i^2) \quad (10)$$

$$F_s=S_BY\pi(r_o^3-r_i^3)/L_b<TFO_B \quad (11)$$

$$\theta_B=S_BL_c/r_o<TFO_B+180 \quad (12)$$

$$C=GF_s/A_bF_w<TFO_B \quad (13)$$

where:

Y—tensional elastic constant, Young's modulus $\pi$—mathematical constant 3.14

$r_o$—outer radius of compliant sub $r_i$—inner radius of compliant sub $L_b$—length between bit and compliant sub $L_c$—length of compliant sub G—geometric factor for particular system configuration Torque sensor relations: FIG. 14*e* illustrates torque sensor outputs 564*a* and 564*b*. These outputs have component signals due to the weight-on-bit and bending as well as torque. The effect of weight is removed by subtracting 564*b* from 564*a* giving 564*a*-564*b*. This subtracted signal 564*a*-564*b* is averaged over one revolution of the compliant sub to yield the constant value of torque strain 598, $S_T$, in FIG. 14*e*. The equation used to convert the torque strain, $S_T$, into the the rotary torque, T, is:

$$T=S_TY\pi(r_o^4-r_i^4)/2(1+\mu)r_o \quad (14)$$

where:

$\mu$-poisons's ratio for the compliant sub material, ~0.3 for steel

A DRD assembly: FIG. 14*a* is a suitable assembly to utilize the shear force method of directional drilling wherein 600 is either a non-rotating or standard centralizing stabilizer placed at a distance 555, L, from the bit. The eccentricity 75, E, in FIG. 14*b* is the causative agent for and is proportional to $F_S$. For the assembly in FIGS. 14*a* and *b*, the parametric control equation is:

$$E=fkCA_bLF_w<TFO_B+O \quad (15)$$

where:

L—length between the bit and centralizing stabilizer, FIG. 14*a* 555

$A_b$—drill bit drilling efficiency anisotropy k—a constant such that the expected value of f in isotropic formations is one f—the adaptive factor O—the adaptive offset Controlled Stabilizer Modes of Operation The most salient function of a controlled stabilizer is to control the direction of drilling by controlling, in some manner, the eccentricity of the rotating drill within the borehole. Several non-rotating controllable stabilizers employing a variety of mechanisms to control the eccentricity to various extents have been described. Consequently, different modes of operation are possible; that is, there are different ways to interface the control mechanisms to achieve the same or different drilling results. A few of the many possible modes will be described to illustrate the concept. Controlled $F_S/F_w$ ratio mode: This is a preferred mode which requires the following elements: 1.) controllable eccentricity, 2.) controllable TFO of eccentricity, 3.) strain measurements and calculation of $F_w$, $F_S$, and $TFO_B$, and 4.) a drilling assembly designed to use the shear force method only. (The desired hole curvature and direction are known from independent consideration not considered a part of this mode.) The appropriate values of $F_SF_w$, and $TFO_B$ are calculated to drill the desired curvature and direction. The measured values of $F_w$, $F_S$, and $TFO_B$ are continuously monitored and adjusted to produce the desired calculated values of $F_S/F_w$, and TFOB by controlling the eccentricity and its TFO. ($F_w$ is controlled at the surface by the driller and varies significantly in time. $F_S$ and $TFO_B$ are controlled downhole via eccentricity and its direction.) The salient aspect of this mode is that one set of parameters, eccentricity and its direction, is manipulated to dynamically maintain another set of parameters, $F_S/F_w$ and $TFO_B$, at desired values.

Distributed TFO mode: This mode requires a minimum of a non-rotating stabilizer with excessive eccentric offset which has controllable TFO such as in FIGS. 5*a–c*. The desired hole curvature and direction are given. The generic mode is to drill multiple short segments of the hole which have excessive curvature and the TFO of the segments are distributed such that the interval over a group of successive segments has an average curvature and TFO equal to the desired values. A specific and simple variant of this mode is where the TFO distribution has only two values; the desired TFO and the desired TFO plus 180 degrees.

Controlled Eccentricity and TFO: This mode requires a non-rotating stabilizer with independently controllable eccentricity and TFO such as in FIGS. 6*a–e*. The desired hole curvature and direction are given. Calculate the eccentricity required by the particular tool parametrics to drill the desired curvature. Set the stabilizer to this calculated eccentricity in the desired TFO direction.

Controlled Vane Force and TFO: This mode requires a non-rotating stabilizer with independently adjustable vanes such as in FIGS. 7*a–d*. The desired hole curvature and direction are given. Calculate the required individual vane force, or position required to produce that force, as a function of vane TFO required to drill the desired curvature and direction. If the vanes are hydraulically operated either the vane forces or the vane positions are set. If the vanes are mechanically operated the vane positions are set.

Other modes: Many other analytical, deterministic modes exist, too numerous to detail, and are included in the nature of the invention. All deterministic processes produce imperfect results or residual error, however small.

Adaptive mode: The adaptive mode is a supplementary mode and can be used in conjunction with any of the above deterministic modes to reduce any errors in the analytical models and correct for unaccounted for factors such as formation drillability anisotropy and can be used with any control mechanism. The basic process is to compare measured curvature and TFO of the actual drilled hole with the planned or desired values of curvature and TFO and use any residual differences to modify the control parameters in such a manner as to offset the residual error. This adaptive mode can be reiterated on each successive section drilled. The salient property of the adaptive mode is the correction for any error observed on the last section drilled in the section ahead.

Predictive mode: The predictive mode is the inclusion into the control settings changes to offset the effects of changing drilling variables at the depths they are predicted to occur. Such predictable changes include changes in drillability anisotropy or crossing of a fault predicted from lithological information such as well logs. The predictive mode is a adjunct to the deterministic modes.

Corrective mode: The corrective mode is a process of drilling to offset any deviation of the drilled well profile from the planned well profile. An effective corrective mode is to make a new planned well profile which connects the current drilled well profile to a deeper point on the original planned well profile or other more desirable deeper point.

Drilled Hole Profile

A profile of the well as drilled is calculated downhole in the central processor as directional surveys are taken. Three things are needed to calculate the drilled well profile: (1.) directional survey data, (2.) the measured depths at which the directional surveys are taken, and (3.) a suitable algorithm. Directional survey sensors are state-of-the-art and part of the downhole data acquisition system. Multiple methods and means for acquiring measured depth downhole are a part of this invention described earlier. Several good algorithms for calculating the well profile are state-of-the-art. One or more of these is stored in the processing system. The accuracy of the well profile is enhanced by frequent directional survey data which is available on an essentially continuous basis. The well profile must be calculated with sequentially deeper data and can be current to the last data in.

Stored Well Plan Profile

A desired well plan profile to be drilled is stored in the downhole central processor system. This stored well plan profile may be updated by either of three methods during the course of drilling the well: (1.) the stored plan may be updated at the surface whenever the downhole system is tripped out to the surface, (2.) Surface-to-downhole data communication can update the well plan, and (3.) the well plan may be updated or modified by the downhole central processor. An example of downhole modification of the well plan is the corrective mode described earlier. In general, modifications to the well plan are small and are for the purpose of minimizing dog leg of the hole and improving the accuracy of hitting a desired target.

Automatic Drill Along Planned Profile

All the necessary elements required to automatically directionally rotary drill along or very close to a preplanned deviated three-dimensional well profile have been described; many of which are inventions of new methods and means. The automatic drilling system is capable of drilling non-stop from "spud" to "TD" along the stored well plan profile and through the target with high accuracy and without assistance, instruction, or interference from the surface in any manner. Oil or gas wells are not normally drilled without pulling the drilling system for various reasons such as setting casing, changing drill bits, or making needed repairs.

Hole Quality and Speed

The quality of hole drilled by this automatic rotary system is much higher than that drilled state-of-the-art directional drilling systems. The reasons for this include the following: (1.) In conventional systems, the large deviations of the drilled well from the well plan during periods of no directional control which are subsequently corrected by installation of directional drilling systems cause large amounts of curvature or dog leg in the drilled hole. These macro dog leg effects which cause unwanted torque and drag in the drilling system are eliminated by the subject invention. (2.) The rotating stabilizers and longer open hole times of the conventional systems cause more wear and erosion of the borehole which contributes seriously to trouble and loss of the hole. (3.) In the case of conventional bent housing downhole motor systems, only one equivalent eccentricity is available; consequently, it is selected to be excessive which drills at an excessive rate of curvature at constant TFO and with no curvature when the drill is rotated. Periods of rotation and no rotation are interspersed to achieve a desired average curvature which process leads to excessive micro dog leg causing frictional torque and drag of the drill string. These micro dog legs are eliminated by the subject invention.

The speed of drilling is increased or the time to complete the well is decreased by the new system in the following ways: (1.) The new system uses rotary drilling which is much faster than downhole motor drilling (2.) The new system saves many trips normally required by conventional systems to change designs, exchange worn motors, etc, and (3.) the directional system in no way inhibits the full optimization of rotary drilling parameters such as weight-on-bit, torque, rotary speed or mud flow rate.

DRD SYSTEM OVERVIEW

Automatic Adaptive DRD Along Plan

Figure 15:
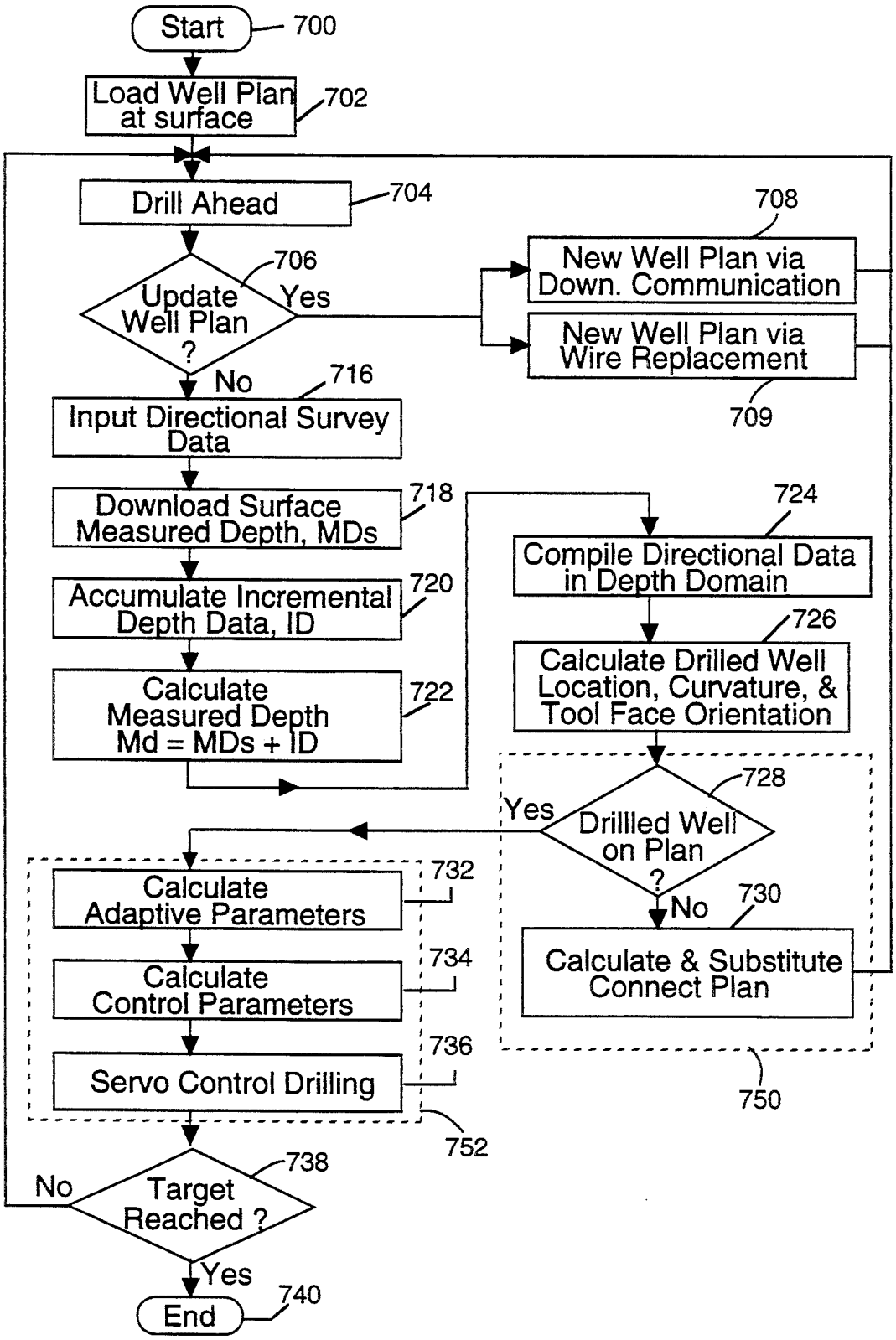
FIG. 15 is a flow chart of the automatic directional drilling system.

FIG. 15 is a flow chart of the automatic adaptive DRD process for drilling a directional well along the planned profile. The process operates at two distinct levels of automatic homing on the plan: adaptive directional control 752 and drilled profile control 750. Immediately after start 700, the well plan is located in step 702, including location, curvature, and tool face orientation is loaded into the system memory at the surface before beginning drilling in step 704. In step 706 a decision is made of whether the well plan should be updated. If the decision to update the well plan is "yes", a new plan or modification is supplied from the surface through the downward communication channel in step 708 or by direct wire replacement in step 709 of the well plan memory.

Directional survey data are input in step 716, the surface measured depth, MDs, is downloaded via downward communications from the surface in step 718, and incremental depth data are input and accumulated, ID in step 720. In step 722, the measured depth, MD=MDs+ID, is calculated and the directional data are compiled in the depth domain in step 724. In step 726, this data is used to calculate the drilled well profile including the location, curvature, and tool face orientation.

The drilled well profile control program block 750 asks whether the drilled well location is the same as the well plan location in step 728. If the plan is not the same, a connect plan is calculated in step 730 and substituted for the well plan. The connect plan is typically a relatively short, low curvature plan connecting from the end of the drilled well to a point on the well plan downhole. This connect process assures that the drilled well remains near the well plan and homes on it.

The automatic adaptive directional control process shown by block 752 consists of calculating adaptive parameters in step 732 using an adaptive control equation and then using the equation to calculate servo control parameters in step 734. These control parameters are then maintained by servo mechanisms to provide automatic servo control drilling as shown in step 736.

Drilling is continued until step 738, where a determination is made of whether the target has been reached. If it is determined that the target has not been reached, the system returns to step 704. Otherwise, the automatic DRD process ends in step 740.

The exact nature of the servo control depends on the directional drilling method used (steering method, shear force method, or combination), the geometry of the assembly, the type of controlled stabilizer used, and the actuating means used within the controlled stabilizer, etc.

Details of the adaptive directional control process 752: The following is a list of adaptive directional formulae used in the implementation of adaptive control equation (15):

$$\overline{C_m} = \frac{C_{mn} + C_{m(n-1)} + \ldots C_{m1}}{n} \tag{16}$$

$$\overline{C_p} = \frac{C_{pn} + C_{p(n-1)} + \ldots C_{p1}}{n} \tag{17}$$

$$d_{ci} = (\overline{C_p} - \overline{C_m})_i \tag{18}$$

$$f_i = f_{(i-1)}(\overline{C_p}/\overline{C_m})_{(i-1)} \tag{19}$$

$$\text{update } f_i \text{ when: } d_c > \frac{k\sigma_c}{\sqrt{n}} \tag{20}$$

$$\overline{A_m} = \frac{A_{mn} + A_{m(n-1)} + \ldots A_{m1}}{n} \tag{21}$$

$$\overline{A_p} = \frac{A_{pn} + A_{p(n-1)} + \ldots A_{p1}}{n} \tag{22}$$

-continued $$d_{Ai} = (\overline{A_p} - \overline{A_m})_i \quad (23)$$

$$O_i = O_{(i-1)}(\overline{A_p} - \overline{A_m})_{(i-1)} \quad (24)$$

$$\text{update } O_i \text{ when: } d_A > \frac{k\sigma_A}{\sqrt{n}} \quad (25)$$

where:

C—curvature, deg./100 ft
$C_m$—measured curvature
$C_p$—planned curvature
$\sigma_c$—standard deviation of C
$d_c$—deviation in C
f=curvature adaptive factor
N=number of samples
i=control interval indicator
A=TFO, deg. clockwise from high
$A_m$=measured TFO
$A_p$=planned TFO
$\sigma_A$=standard deviation of A
$d_A$=deviation in TFO
O=TFO adaptive offset
k=response factor; typically 2 to 3

Figure 16:
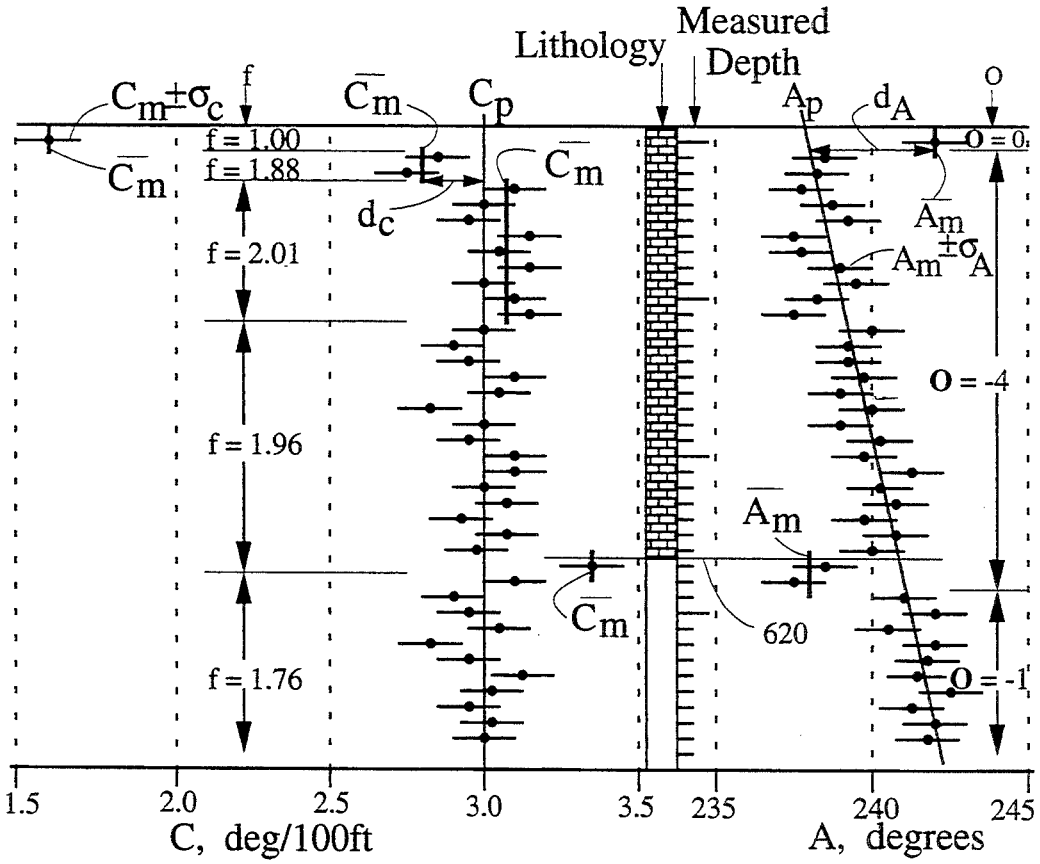
FIG. 16 is an illustration of the adaptive directional control system.

FIG. 16 illustrates the adaptive control process and is a plot of the curvature C, the TFO (tool face orientation) direction A, and lithology as a function of measured depth. The planned values of $C_p$ and TFO direction $A_p$ are shown as solid lines. The measured values of curvature and standard deviation, $C_m \pm \sigma_c$, and the measured values of TFO direction and standard deviation, $A_m \pm \sigma_A$, are shown as a dot representing the measured value and bars representing the ± standard deviation. The average value of $C_m$, $\overline{C}_m$, and $A_m$, $\overline{A}_m$, are shown as solid lines over the averaged interval of data. The adaptive factor f and adaptive offset O in equation (15) are determined as follows. At the beginning, drilling is begun using f=1 and O=0. After enough drilling to obtain data, the first values of $C_m \pm \sigma_c$ and $A_m \pm \sigma_A$ are plotted and the statistical operations described in the adaptive formulae are carried out. The primary functions are: 1.) compute the average value of C and A, $\overline{C}_m$ and $\overline{A}_m$, using the last n measured values of each, 2.) compute the average values $C_p$ and $A_p$, $\overline{C}_p$ and $\overline{A}_p$, over the same depth interval as the measured values were averaged, 3.) Calculate the deviation in C, $d_c$, and the deviation in A, $d_A$, as in formulae (18) and (23). 4.) Determine if f and/or O should be updated using formulae (20) and (25). 5. Update f and O using equations (19) and (24) as indicated-End of operations. The basic function of formulae (20) and (25) is to cause updating of the adaptive parameters only when the data deviate significantly from the planned values. Now back to the data sequence. The first measured values of C and A deviated significantly from the planned values; consequently, new values of f=1.88 and O=−4 were computed and applied as seen in the f and O columns. The value of $d_A$ is shown. The value of $d_c$ is not shown in the this case. Another set of measured C and A are taken. The statistical tests show no need to update either f or O. A third measured data set trigger an update of f=2.01 but no O update. The value of $d_c$ is shown. Nine more sets of measured data are required before the deviation in C becomes statistically significantly to update to f=1.96. The deviation in A remains statistically insignificant. Many more measured data sets are taken with no update in either f of O. Then a change in the lithology 620 is encountered. The first measured C into the new lithology caused an update of f=1.76 and a second measured A into the new lithology caused an update of O=−1. These values of the adaptive parameters hold for the rest of the data sequence. Two notable properties should be observed: 1.) The adaptive system is responsive to the anisotropic drilling properties of the formation not included in the control equation except as as adaptive parameter and 2.) the adaptation to the formation drilling anisotropy (or any element that causes the measured values of C and A to depart from their planned values) is swift and accurate. This speed of reaction is due to the manner in which the measured values are averaged over the last n samples.

Figure 17:
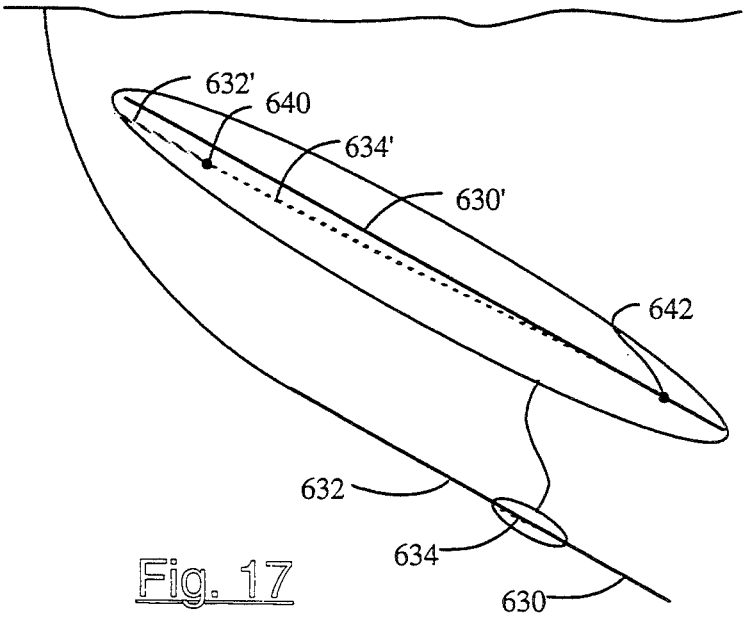
FIG. 17 is an illustration of the corrective connect plan method.

Details of the drilled profile control 750: FIG. 17 illustrates a planned well profile 630 with a solid line, a drilled well profile 632 with a dashed line, and a connect plan profile 634. In the magnified view, the connect plan 634' begins at 640 where the drilled well profile 632' ends. The connect plan 634' ends at 642 where it becomes coincident with and in the same direction as the original planned well profile 630'. The connect plan is automatically computed in the downhole system using an algorithm selected to minimize the dogleg. The connect plan method causes the drilled well to continually home on the planned well profile in an optimum manner thus insuring that the drilled well profile always remains very near the plan.

Although the method and apparatus of the present invention has been described in connection with the preferred embodiment, it is not intended to be limited to the specific form set forth herein, but, on the contrary, it is intended to cover such alternatives, modifications and equivalents as can reasonably be included within the spirit and scope of the invention as defined by the appended claims.

What is claimed is:

1. A system for drilling a borehole and determining depth of a drill bit within said borehole, comprising:

a drill string;

a drill bit carried on said drill string;

means for rotating said drill bit; and downhole means carried on said drillstring for obtaining downhole measured data for determining the depth of said drill bit within said borehole.

2. The system according to claim 1, further comprising downhole receiver means for receiving a telemetered measurement of depth of said borehole, said telemetered depth measurement being made at the surface.

3. The system according to claim 2, further comprising calculating means for receiving data from said downhole means for obtaining data for determining depth, said calculating means being operable to calculate downhole measured depth as a function of telemetered surface measured depth and integral downhole measured incremental depth.

4. The system according to claim 1, said means for determining said depth of said drill bit comprising a depth wheel including means for detecting rotation of said wheel within said borehole.

5. The system according to claim 4, said depth wheel comprising biasing means for urging said wheel into contact with said borehole.

6. The system according to claim 5, the outer perimeter of said depth wheel comprising means to prevent slippage between said depth wheel and the surface of said borehole.

7. The system according to claim 6, said means for detecting rotation of said wheel comprising encoder means for converting rotation of said wheel to incremental change in depth of said borehole.

8. The system according to claim 7, said encoder means comprising a magnetic encoder, said magnetic encoder producing a series of pulses indexed to the rotation of said wheel, said pulses being correlatable with incremental change in depth of said borehole.

9. A system for drilling a borehole and determining depth of said drill bit within a borehole comprising:

a drill string;

a drill bit carried on said drill string;

means for rotating said drill bit;

means for obtaining data for determining the direction of said borehole;

downhole means carried on said drillstring for obtaining downhole measured data for determining the depth of said drill bit within said borehole; and means for combining data relating to depth and direction of said borehole to obtain a drilled profile of said borehole.

10. The system according to claim 9, further comprising downhole receiver means for receiving a telemetered measurement of depth of said borehole, said telemetered depth measurement being made at the surface.

11. The system according to claim 10, further comprising calculating means for receiving data from said downhole means for obtaining data for determining depth, said calculating means being operable to calculate downhole measured depth as a function of telemetered surface measured depth and integral downhole measured incremental depth.

12. The system according to claim 11, said means for determining said depth of said drill bit comprising a depth wheel including means for detecting rotation of said wheel within said borehole.

13. The system according to claim 12, said depth wheel comprising biasing means for urging said wheel into contact with said borehole.

14. The system according to claim 13, the outer perimeter of said depth wheel comprising means to prevent slippage between said depth wheel and the surface of said borehole.

15. The system according to claim 14, said means for detecting rotation of said wheel comprising encoder means for converting rotation of said wheel to incremental change in depth of said borehole.

16. The system according to claim 15, said encoder means comprising a magnetic encoder, said magnetic encoder producing a series of pulses indexed to the rotation of said wheel, said pulses being correlatable with incremental change in depth of said borehole.

* * * * *